US009431712B2

(12) United States Patent
Abadi et al.

(10) Patent No.: US 9,431,712 B2
(45) Date of Patent: Aug. 30, 2016

(54) ELECTRICALLY-SMALL, LOW-PROFILE, ULTRA-WIDEBAND ANTENNA

(71) Applicant: Wisconsin Alumni Research Foundation, Madison, WI (US)

(72) Inventors: Seyed Mohamad Amin Momeni Hasan Abadi, Madison, WI (US); Nader Behdad, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 345 days.

(21) Appl. No.: 13/899,726

(22) Filed: May 22, 2013

(65) Prior Publication Data

US 2014/0347243 A1 Nov. 27, 2014

(51) Int. Cl.

| | |
|---|---|
| ***H01Q 9/04*** | (2006.01) |
| ***H01Q 1/48*** | (2006.01) |
| ***H01Q 5/25*** | (2015.01) |
| ***H01Q 5/364*** | (2015.01) |
| ***H01Q 9/36*** | (2006.01) |

(52) U.S. Cl.

CPC ..... *H01Q 9/0421* (2013.01); *H01Q 1/48* (2013.01); *H01Q 5/25* (2015.01); *H01Q 5/364* (2015.01); *H01Q 9/045* (2013.01); *H01Q 9/0442* (2013.01); *H01Q 9/36* (2013.01)

(58) Field of Classification Search

None

See application file for complete search history.

(56) References Cited

U.S. PATENT DOCUMENTS

| | | | | |
|---|---|---|---|---|
| 2,485,675 | A | | 10/1949 | Taylor et al. |
| 3,967,276 | A | | 6/1976 | Goubau |
| 4,982,197 | A | | 1/1991 | Villaseca et al. |
| 5,146,232 | A | * | 9/1992 | Nishikawa ..... H01Q 1/32 343/713 |
| 5,304,998 | A | | 4/1994 | Lopez |
| 5,568,157 | A | | 10/1996 | Anderson |
| 5,654,724 | A | | 8/1997 | Chu |
| 5,666,126 | A | | 9/1997 | Lange |
| 5,784,032 | A | | 7/1998 | Johnston et al. |
| 5,852,421 | A | | 12/1998 | Maldonado |
| 6,014,107 | A | | 1/2000 | Wiesenfarth |
| 6,054,963 | A | | 4/2000 | Muterspaugh |
| 6,163,302 | A | | 12/2000 | Bjorkengren et al. |

(Continued)

FOREIGN PATENT DOCUMENTS

WO WO 2005/011050 2/2005

OTHER PUBLICATIONS

Behdad et al., A Very Low-Profile, Omnidirectional, Ultrawideband Antenna, IEEE Antennas and Wireless Propagation Letters, vol. 12, Feb. 22, 2013, pp. 280-283.

(Continued)

*Primary Examiner* — Robert Karacsony

(74) *Attorney, Agent, or Firm* — Bell & Manning, LLC

(57) ABSTRACT

An ultra-wideband, low profile antenna is provided. The antenna includes a ground plane substrate, a feed conductor, a top hat conductor, a shorting arm, and a ring slot. The feed conductor includes a first end and a second end. The first end is configured for electrical coupling to a feed network through a feed element extending from the ground plane substrate. The top hat conductor includes a generally planar sheet mounted to the second end of the feed conductor in a first plane approximately parallel to a second plane defined by the ground plane substrate. The shorting arm includes a third end and a fourth end. The third end is mounted to the top hat conductor, and the fourth end is mounted to the ground plane substrate. The ring slot is formed in the ground plane substrate around the feed element.

20 Claims, 29 Drawing Sheets

(56) References Cited

U.S. PATENT DOCUMENTS

| | | | | |
|---|---|---|---|---|
| 6,329,955 | B1 | 12/2001 | McLean et al. | |
| 6,336,036 | B1 | 1/2002 | Hayes | |
| 6,348,897 | B1 | 2/2002 | Alameh et al. | |
| 6,720,929 | B2 | 4/2004 | Nybeck et al. | |
| 6,720,930 | B2 | 4/2004 | Johnson et al. | |
| 6,828,948 | B2 | 12/2004 | Volman et al. | |
| 7,046,199 | B2 | 5/2006 | Montgomery et al. | |
| 7,215,292 | B2 | 5/2007 | McLean | |
| 7,268,741 | B2 | 9/2007 | Sarabandi et al. | |
| 7,760,151 | B2 | 7/2010 | Poilasne et al. | |
| 7,764,242 | B2 | 7/2010 | Milyakh | |
| 8,068,064 | B2 * | 11/2011 | Yanagisawa | H01Q 7/00 343/702 |
| 8,184,060 | B2 | 5/2012 | Du et al. | |
| 8,228,251 | B1 | 7/2012 | Behdad et al. | |
| 8,237,617 | B1 | 8/2012 | Johnson et al. | |
| 2004/0090372 | A1 | 5/2004 | Nallo et al. | |
| 2005/0083236 | A1 * | 4/2005 | Louzir | H01Q 1/241 343/725 |
| 2006/0012535 | A1 | 1/2006 | McLean | |
| 2006/0055619 | A1 | 3/2006 | Sarabandi et al. | |
| 2007/0279296 | A1 | 12/2007 | Sarabandi et al. | |
| 2009/0153303 | A1 | 6/2009 | Forster | |
| 2015/0357715 | A1 | 12/2015 | Behdad et al. | |

OTHER PUBLICATIONS

International Search Report and Written Opinion issued in PCT/US2011/038560, Apr. 26, 2012.

Notice of Allowance for U.S. Appl. No. 14/296,138, mailed on Jan. 20, 2016, 4 pp.

* cited by examiner

ELECTRICALLY-SMALL, LOW-PROFILE, ULTRA-WIDEBAND ANTENNA

REFERENCE TO GOVERNMENT RIGHTS

This invention was made with government support under MSN141269 awarded by the Office of Naval Research and MSN139974 awarded by the National Science Foundation. The government has certain rights in the invention.

BACKGROUND

A classical monopole antenna is a type of radio antenna that consists of a straight rod-shaped conductor that is typically mounted perpendicularly over some type of conductive surface, called a ground plane. In some cases, the ground plane is the earth's surface, while in other cases, the ground plane is formed of a conductive material. The classical monopole antenna has an omnidirectional radiation pattern meaning that it radiates equal power in all azimuthal directions perpendicular to the antenna resulting in a donut shaped radiation pattern. The height of monopole antennas is inversely related to the transmission frequency because operation at low frequencies results in a very large electromagnetic wavelength. As a result, a traditional monopole antenna operating at low frequencies is also physically very large. The physically large size makes the monopole antenna challenging to use in low-profile applications at low frequencies.

SUMMARY

In an illustrative embodiment, an ultra-wideband, low profile antenna is provided. The antenna includes, but is not limited to, a ground plane substrate, a feed conductor, a top hat conductor, a shorting arm, and a ring slot. The feed conductor includes, but is not limited to, a first end and a second end. The first end is configured for electrical coupling to a feed network through a feed element extending from the ground plane substrate. The top hat conductor includes, but is not limited to, a generally planar sheet mounted to the second end of the feed conductor in a first plane approximately parallel to a second plane defined by the ground plane substrate. The shorting arm includes, but is not limited to, a third end and a fourth end. The third end is mounted to the top hat conductor, and the fourth end is mounted to the ground plane substrate. The ring slot is formed in the ground plane substrate around the feed element.

In another illustrative embodiment, a transmitter is provided. The transmitter includes, but is not limited to, a matching network circuit and an antenna. The matching network circuit is coupled to receive a signal through a port and to form a matched signal output through a feed element. The antenna includes, but is not limited to, a ground plane substrate, a feed conductor, a top hat conductor, a shorting arm, and a ring slot. The feed conductor includes, but is not limited to, a first end and a second end. The first end is configured for electrical coupling to the matching network circuit through the feed element to receive the matched signal. The top hat conductor includes, but is not limited to, a generally planar sheet mounted to the second end of the feed conductor in a first plane approximately parallel to a second plane defined by the ground plane substrate. The shorting arm includes, but is not limited to, a third end and a fourth end. The third end is mounted to the top hat conductor, and the fourth end is mounted to the ground plane substrate. The ring slot is formed in the ground plane substrate around the feed element. The matching network circuit is configured to impedance match the antenna.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1A:
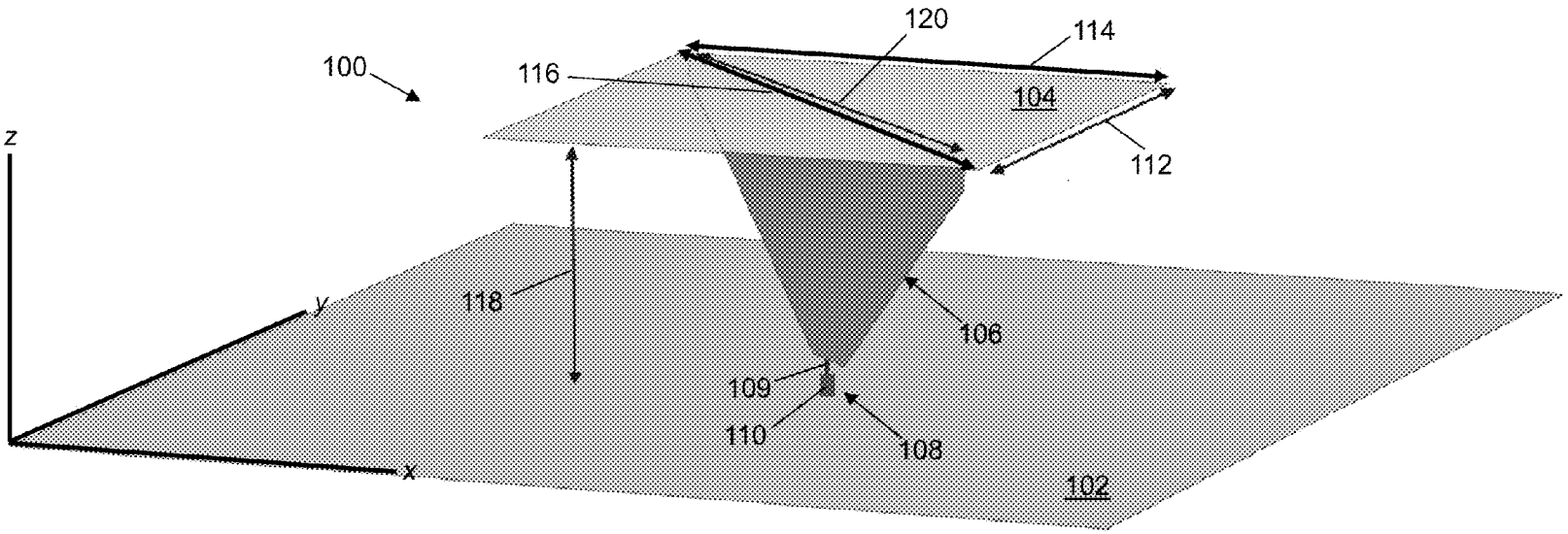
FIG. 1*a* is a perspective view of a top-loaded conical antenna in accordance with an illustrative embodiment.

With reference to FIG. 1*a*, a perspective view of an antenna 100 is shown in accordance with an illustrative embodiment. Antenna 100 may include a ground plane substrate 102, a top hat conductor 104, a feed conductor 106, and a feed element 108. Ground plane substrate 102 is electrically grounded and may be formed of any material suitable for forming an electrical ground for antenna 100. For example, ground plane substrate 102 may be formed of a metal sheet alone or with a dielectric or magnetic material or a magneto-dielectric material on a top surface of the metal sheet. Ground plane substrate 102 is generally planar and defines a first plane. To describe the orientation of the components of antenna 100, a coordinate reference system x-y-z is included in FIG. 1*a*. Based on the defined coordinate reference system x-y-z, the first plane is the x-y plane.

Though the assumption is made that ground plane substrate 102 is an infinite ground plane, in general, if ground plane substrate 102 is just slightly larger than top hat conductor 104, antenna 100 is still effective as a radiator. For example, ground plane substrate 102 larger by a factor of 1.5 times than top hat conductor 104 is still effective as a radiator. In illustrative embodiment, ground plane substrate 102 is a metal sheet.

Figure 1C:
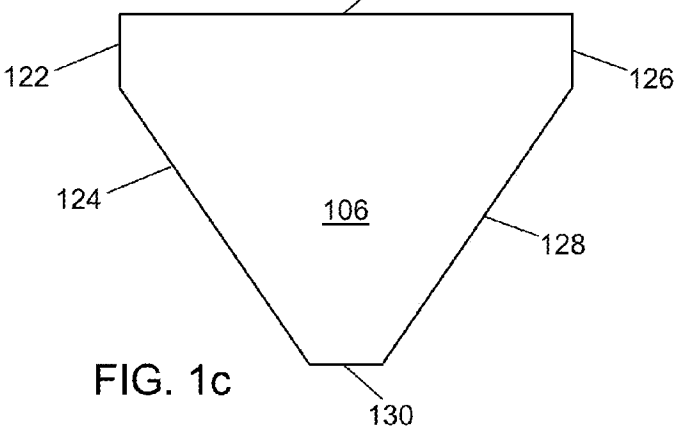
FIG. 1*c* is a side view of a feed conductor of the top-loaded conical antenna of FIG. 1*a* in accordance with an illustrative embodiment.
Figure 1B:
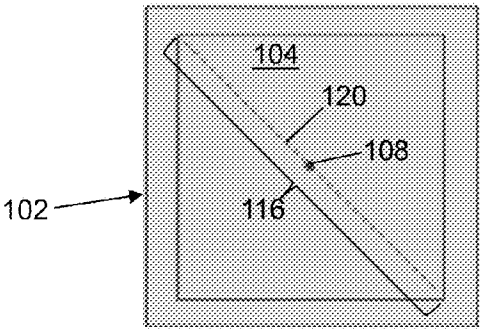
FIG. 1*b* is a top view of the top-loaded conical antenna of FIG. 1*a* in accordance with an illustrative embodiment.

With reference to FIG. 1*b*, a top view of antenna 100 is shown in accordance with an illustrative embodiment. In an illustrative embodiment, top hat conductor 104 is generally planar and oriented in a second plane that is approximately parallel to the first plane defined by ground plane substrate 102. Thus, top hat conductor 104 is oriented parallel to the x-y plane at a height 118 above ground plane substrate 102. Top hat conductor 104 may be formed of any conducting material suitable for forming a radiator of antenna 100.

In an illustrative embodiment, height 118 is approximately 100 millimeters (mm). In the illustrative embodiment, top hat conductor 104 has a rectangular shape when projected into the x-y plane. In alternative embodiments, top hat conductor 104 may form other polygonal, circular, or elliptical shapes when projected into the x-y plane. In the illustrative embodiment, top hat conductor 104 has a length 112 in the y-direction and a width 114 in the x-direction. Length 112 and width 114 define a diagonal 116. In an illustrative embodiment, length 112 and width 114 define are approximately 200 mm though other dimensions may be used depending on the application environment for antenna 100.

With reference to FIG. 1 *c*, a side view of feed conductor 106 is shown in accordance with an illustrative embodiment. Feed conductor 106 is electrically connected to feed element 108. Feed element 108 is positioned approximately at a center of ground plane substrate 102 as shown with reference to FIG. 1*b*. In an illustrative embodiment, feed element 108 is a short length of coaxial cable including an inner connector 109 electrically coupled to a point on feed conductor 106 and an outer conductor 110 electrically coupled to ground plane substrate 102.

In the illustrative embodiment of FIG. 1 *c*, feed conductor 106 is generally planar and oriented in a third plane that is approximately perpendicular to the first plane defined by ground plane substrate 102. Feed conductor 106 may be formed of any conducting material suitable for forming a radiator of antenna 100.

Feed conductor 106 includes a top edge 120, a first side edge 122, a second side edge 124, a third side edge 126, a fourth side edge 128, and a bottom edge 130. Top edge 120 of feed conductor 106 is electrically coupled to top hat conductor 104 along diagonal 116 of top hat conductor 104 as shown with reference to FIGS. 1*a* and 1*b*. In an illustrative embodiment, top edge 120 of feed conductor 106 is shorter than diagonal 116 of top hat conductor 104 though the difference is not readily visible in FIG. 1*b*. As a result, feed conductor 106 is positioned between ground plane substrate 102 and top hat conductor 104.

Top edge 120 and bottom edge 130 are generally parallel. First side edge 122 extends generally perpendicularly from a first end of top edge 120. Second side edge 124 extends between first side edge 122 and a first end of bottom edge 130. Third side edge 126 extends generally perpendicularly from a second end of top edge 120. Fourth side edge 128 extends between third side edge 126 and a second end of bottom edge 130. Thus, first side edge 122 and second side edge 124 form a first side of feed conductor 106, and third side edge 126 and fourth side edge 128 form a second side of feed conductor 106. In the illustrative embodiment, feed conductor 106 is primarily cone shaped. In alternative embodiment, feed conductor 106 may not include first side edge 122 or third side edge 126 and/or bottom edge 130 resulting in a triangular shape. In an illustrative embodiment, feed conductor 106 forms essentially a monopole antenna and can be used to tune and adjust the resonances that result from the monopole structure. These resonances can be optimized such that they merge with the other resonances to form an ultra-wideband antenna. Thus, the shape of feed conductor 106 can be optimized to increase the bandwidth of antenna 100.

Figure 2A:
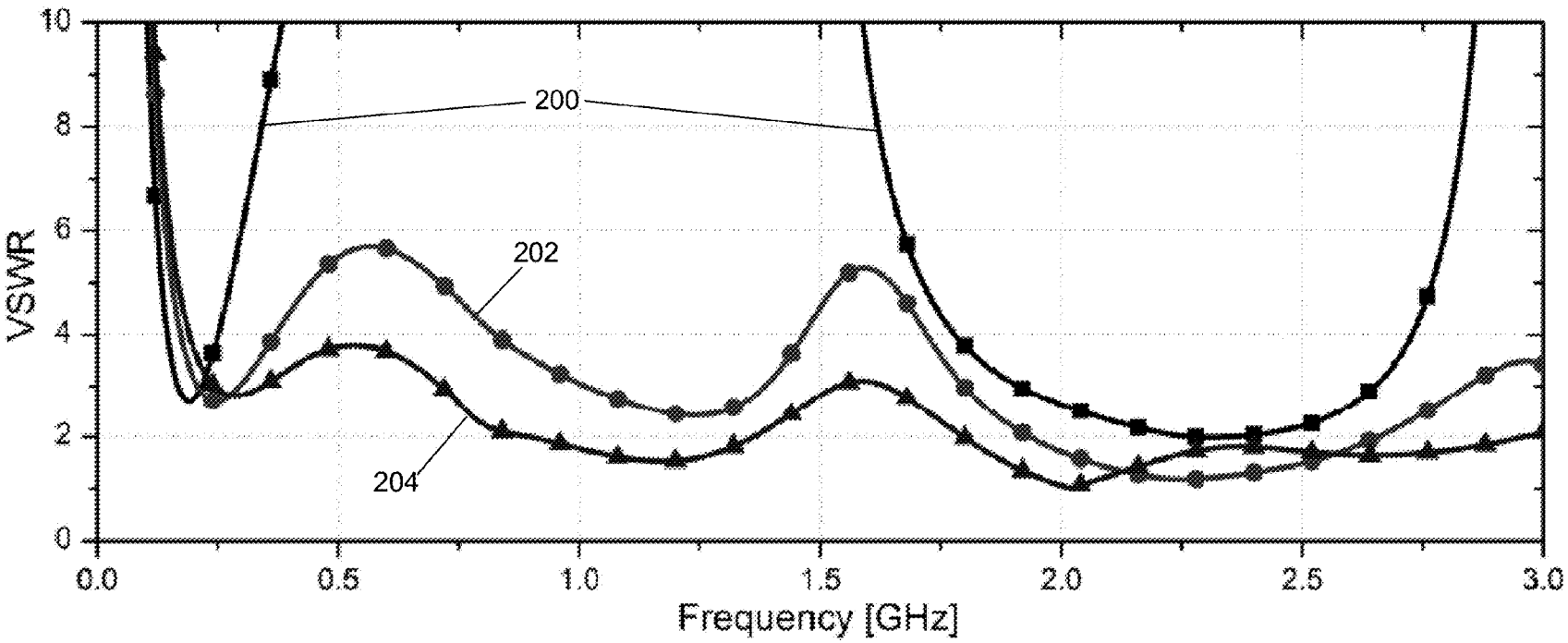
FIG. 2*a* is a graph showing a voltage standing wave ratio (VSWR) determined by simulating the performance of the antenna of FIG. 1*a* with different dimensions for a top edge of a conical structure.

With reference to FIG. 2*a*, a graph is provided that shows a voltage standing wave ratio (VSWR) at feed element 108 determined by simulating the performance of the antenna of FIG. 1*a* with different dimensions for top edge 120 of feed conductor 106. A first VSWR curve 200 shows a VSWR as a function of transmit frequency that results for top edge 120 having a value equal to 55 mm. A second VSWR curve 202 shows a VSWR as a function of transmit frequency that results top edge 120 having a value equal to 140 mm. A third VSWR curve 204 shows a VSWR as a function of transmit frequency that results for top edge 120 having a value equal to 255 mm.

Figure 2B:
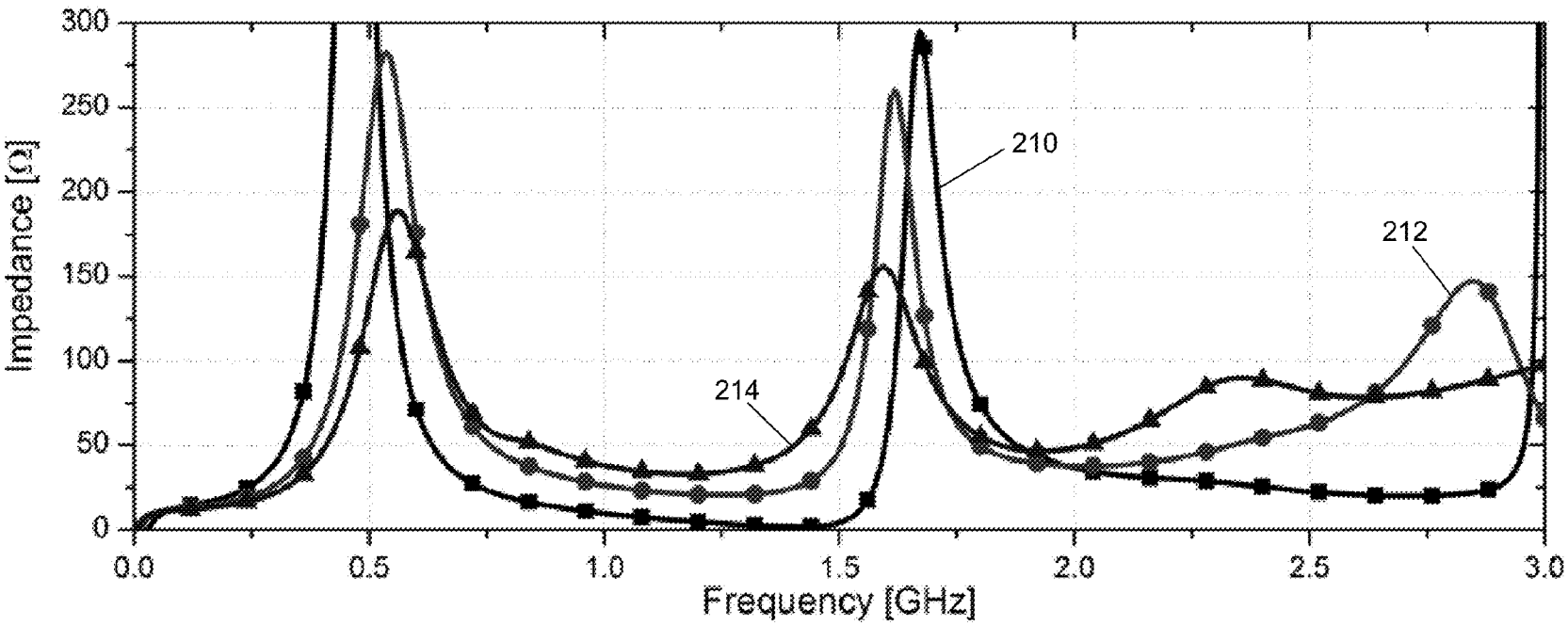
FIG. 2*b* is a graph showing an input resistance determined by simulating the performance of the antenna of FIG. 1*a* with different dimensions for the top edge of the conical structure.

With reference to FIG. 2*b*, a graph is provided that shows an input resistance (real part of the impedance) determined by simulating the performance of the antenna of FIG. 1*a* with different dimensions for top edge 120 of feed conductor 106. A first resistance curve 210 shows a resistance as a function of transmit frequency that results for top edge 120 having a value equal to 55 mm. A second resistance curve 212 shows a resistance as a function of transmit frequency that results for top edge 120 having a value equal to 140 mm. A third resistance curve 214 shows a resistance as a function of transmit frequency that results for top edge 120 having a value equal to 255 mm.

Figure 2C:
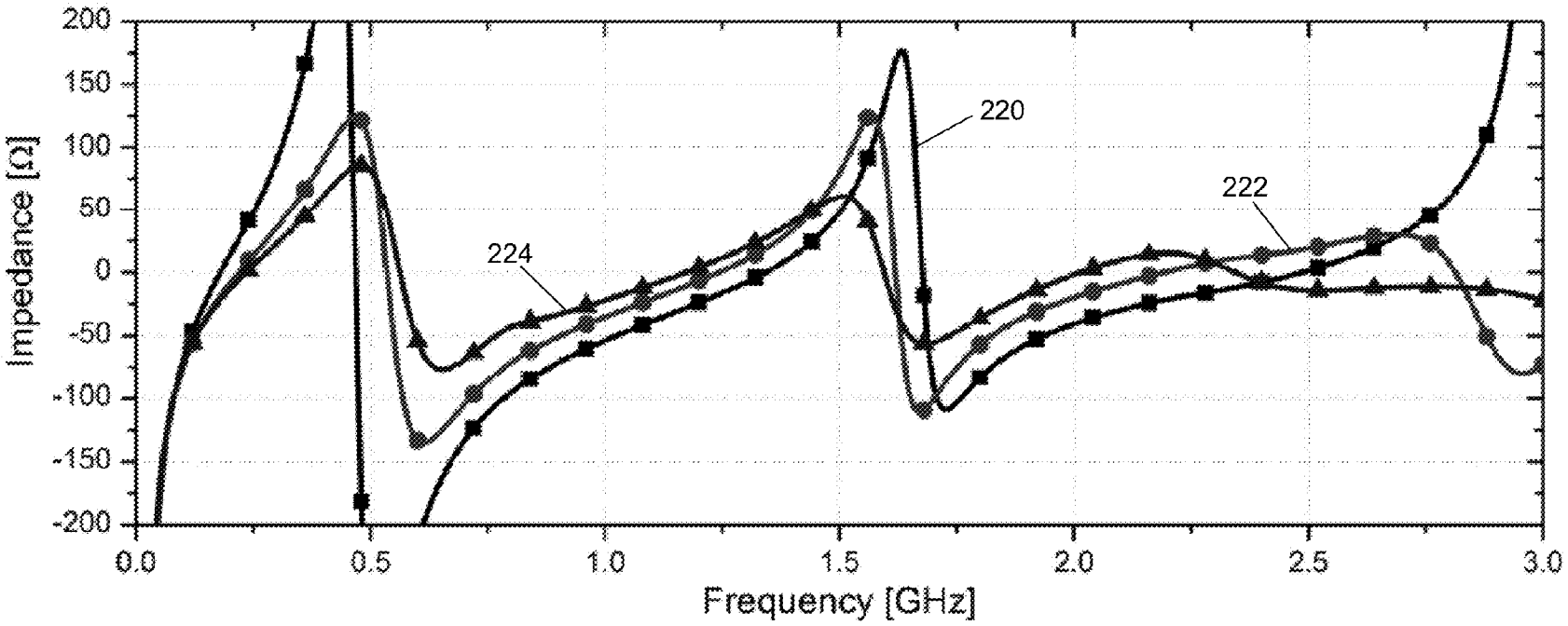
FIG. 2*c* is a graph showing an input reactance determined by simulating the performance of the antenna of FIG. 1*a* with different dimensions for the top edge of the conical structure.

With reference to FIG. 2*c*, a graph is provided that shows an input reactance (imaginary part of the impedance) determined by simulating the performance of the antenna of FIG. 1*a* with different dimensions for top edge 120 of feed conductor 106. A first reactance curve 220 shows a reactance as a function of transmit frequency that results for top edge 120 having a value equal to 55 mm. A second reactance curve 222 shows a reactance as a function of transmit frequency that results for top edge 120 having a value equal to 140 mm. A third reactance curve 224 shows a reactance as a function of transmit frequency that results for top edge 120 having a value equal to 255 mm.

Antenna 100 is a potentially broadband antenna that is primarily a capacitive antenna in which the parallel capacitance between top hat conductor 104 and ground plane substrate 102 is the dominant factor. The magnitude of the parallel capacitance is directly related to the area of top hat conductor 104. To achieve a low frequency of operation, the dimensions of top hat conductor 104 are maximized in view of the dimensional constraints that result based on the application environment for antenna 100. The performance of antenna 100 is examined using full-wave electromagnetic wave (EM) simulations, and the side dimensions of feed conductor 106 are optimized to achieve the lowest VSWR possible over as wide a frequency band as possible.

Figure 3B:
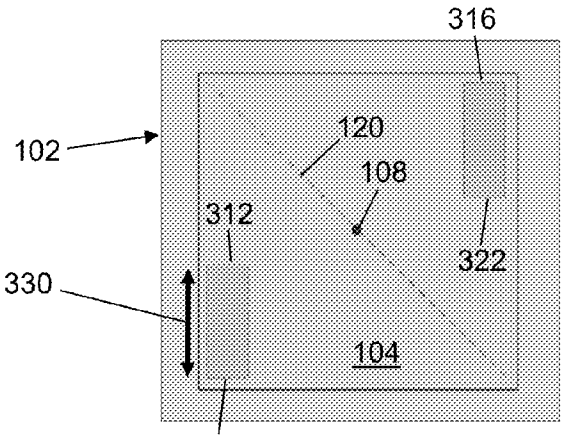
FIG. 3*b* is a top view of the top-loaded conical antenna of FIG. 3*a* in accordance with an illustrative embodiment.
Figure 3A:
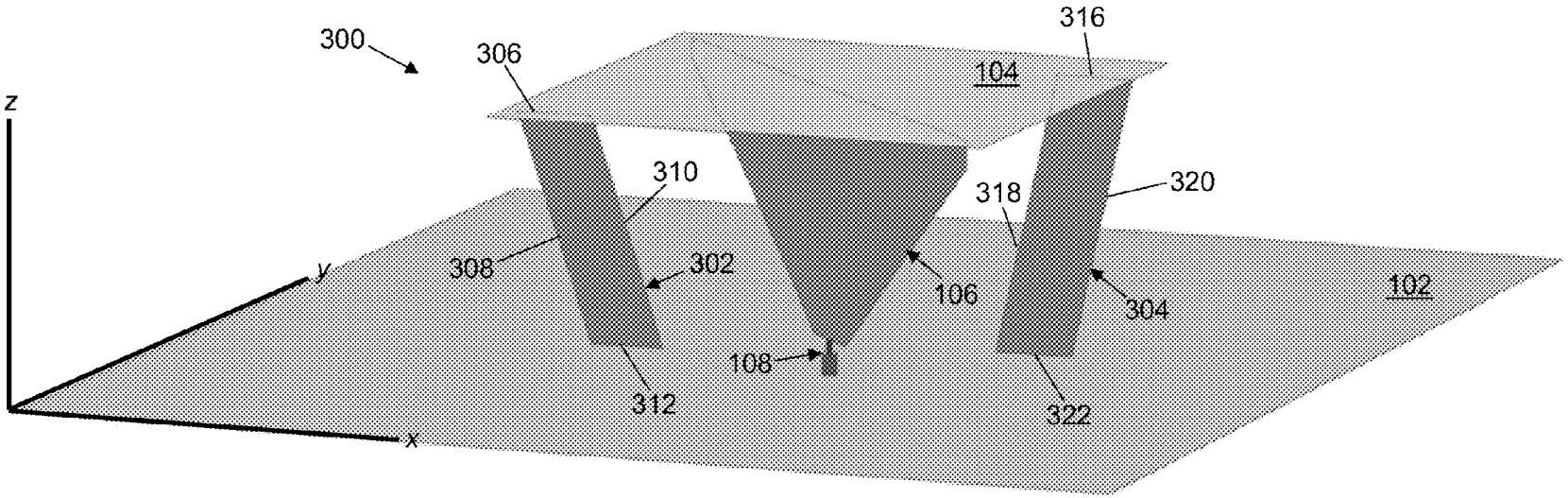
FIG. 3*a* is a perspective view of a top-loaded conical antenna including a plurality of shorting arms in accordance with an illustrative embodiment.

With reference to FIG. 3*a*, a perspective view of a second antenna 300 is shown in accordance with an illustrative embodiment. Second antenna 300 may include ground plane substrate 102, top hat conductor 104, feed conductor 106, feed element 108, a first shorting arm 302, and a second shorting arm 304. A greater or a fewer number of shorting arms may be included in alternative embodiments. In the illustrative embodiment, first shorting arm 302 and second shorting arm 304 are generally planar sheets and rectangular in shape when projected into the x-y, y-z, or x-z planes though other shapes may be used. For example, first shorting arm 302 and second shorting arm 304 may form other polygonal, circular, or elliptical shapes when projected into the x-y, y-z, or x-z planes. First shorting arm 302 and second shorting arm 304 further need not be formed of generally planar sheets.

First shorting arm 302 is electrically coupled to top hat conductor 104 and to ground plane substrate 102 as shown with reference to FIG. 3*b*. Second shorting arm 304 is also electrically coupled to top hat conductor 104 and to ground plane substrate 102 as shown with reference to FIG. 3*b*. First shorting arm 302 and second shorting arm 304 may be formed of any conducting material suitable for forming a radiator of antenna 100. The material used to form first shorting arm 302 and second shorting arm 304 may be the same or different from each other. The material used to form first shorting arm 302 and second shorting arm 304 may be the same or different from that used to form top hat conductor 104 and/or feed conductor 106. The material used to form top hat conductor 104 and feed conductor 106 may be the same or different from each other. In an illustrative embodiment, first shorting arm 302 and second shorting arm 304 may carry relatively strong current densities. To avoid ohmic losses that could adversely impact the performance of antenna 100, good conductors may be used to form first shorting arm 302 and second shorting arm 304.

First shorting arm 302 includes a top edge 306, a first side edge 308, a second side edge 310, and a bottom edge 312. First shorting arm 302 is electrically coupled to top hat conductor 104 along top edge 306. Top edge 306 is positioned in a first corner of top hat conductor 104. First shorting arm 302 is electrically coupled to ground plane substrate 102 along bottom edge 312. Top edge 306 and bottom edge 312 of first shorting arm 302 are generally parallel.

Second shorting arm 304 includes a top edge 316, a first side edge 318, a second side edge 320, and a bottom edge 322. Second shorting arm 304 is electrically coupled to top hat conductor 104 along top edge 316. Top edge 316 of second shorting arm 304 is positioned in a second corner of top hat conductor 104. Second shorting arm 304 is electrically coupled to ground plane substrate 102 along bottom edge 322 of second shorting arm 304. Top edge 316 and bottom edge 322 of second shorting arm 304 are generally parallel. Feed conductor 106 extends between the remaining corners of top hat conductor 104. Thus, first shorting arm 302 and second shorting arm 304 are positioned in opposite corners of top hat conductor 104 on either side of feed conductor 106.

One drawback of adding first shorting arm 302 and second shorting arm 304 to antenna 100 to form second antenna 300 is that the shorting arms are solely responsible for the radiation characteristics at low frequencies, while at higher frequencies they act as an array antenna and can produce undesirable nulls in the radiation patterns. To ensure the antenna maintains consistent omnidirectional radiation patterns across its entire frequency band, the shorting arms are positioned so that the shorting arms are rotationally symmetric. Thus, first shorting arm 302 and second shorting arm 304 extend from top hat conductor 104 and from ground plane substrate 102 at an angle 324 and are positioned to be rotationally symmetric. In an illustrative embodiment, angle 324 is between 10 and 90 degrees. In an alternative embodiment, angle 324 may be approximately zero if first shorting arm 302 and second shorting arm 304 are curved. Considering the currents on shorting arm 302 and second shorting arm 304, this method distributes the currents more symmetrically around antenna 100 and improves the omindirectionality at higher frequencies.

Figure 3C:
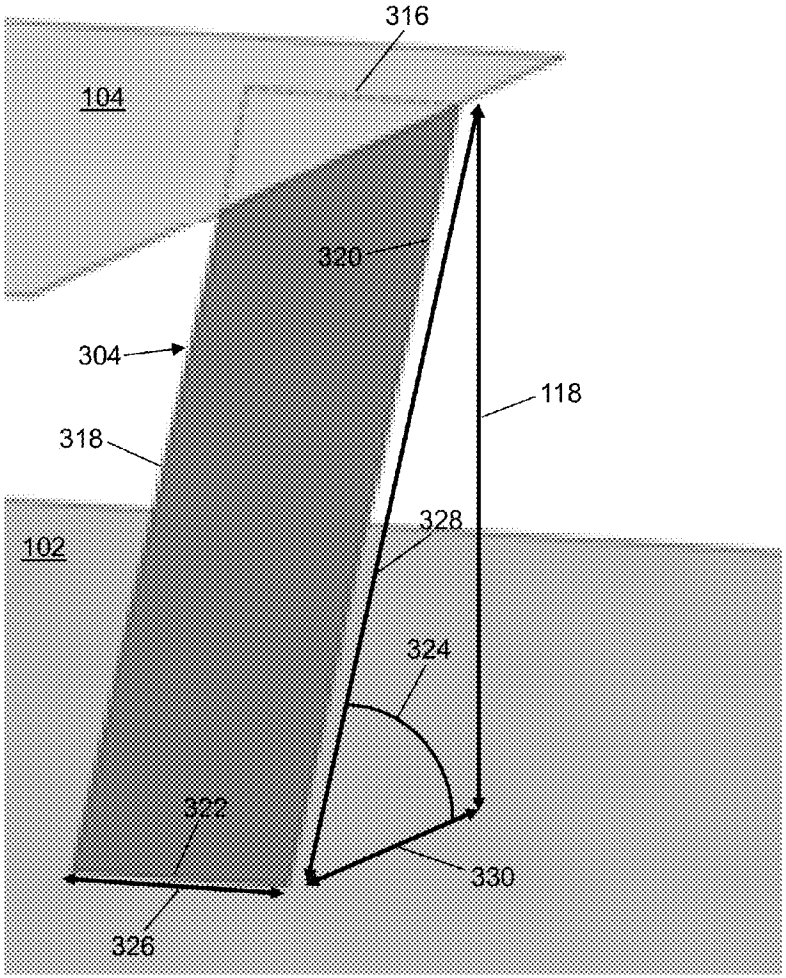
FIG. 3*c* is a perspective view of the top-loaded conical antenna of FIG. 3*a* zoomed to show a shorting arm in accordance with an illustrative embodiment.

Top edge 306 and bottom edge 312 of first shorting arm 302 and top edge 316 and bottom edge 322 of second shorting arm 304 have a width 326. First side edge 308 and second side edge 310 of first shorting arm 302 and first side edge 318 and second side edge 320 of second shorting arm 304 have a length 328. As a result, first shorting arm 302 and second shorting arm 304 have a projected length 330 when projected into the x-y plane as shown with reference to FIGS. 3*b* and 3*c*. Of course, first shorting arm 302 and second shorting arm 304 may be oriented in other directions. For example, bottom edge 312 of first shorting arm 302 and bottom edge 322 of second shorting arm 304 may be rotated from zero to 90 degrees in the x-y plane. In an illustrative embodiment, width 326 is approximately 30 mm and length 328 is approximately 122 mm though other dimensions may be used depending on the application environment for antenna 100.

Figure 4A:
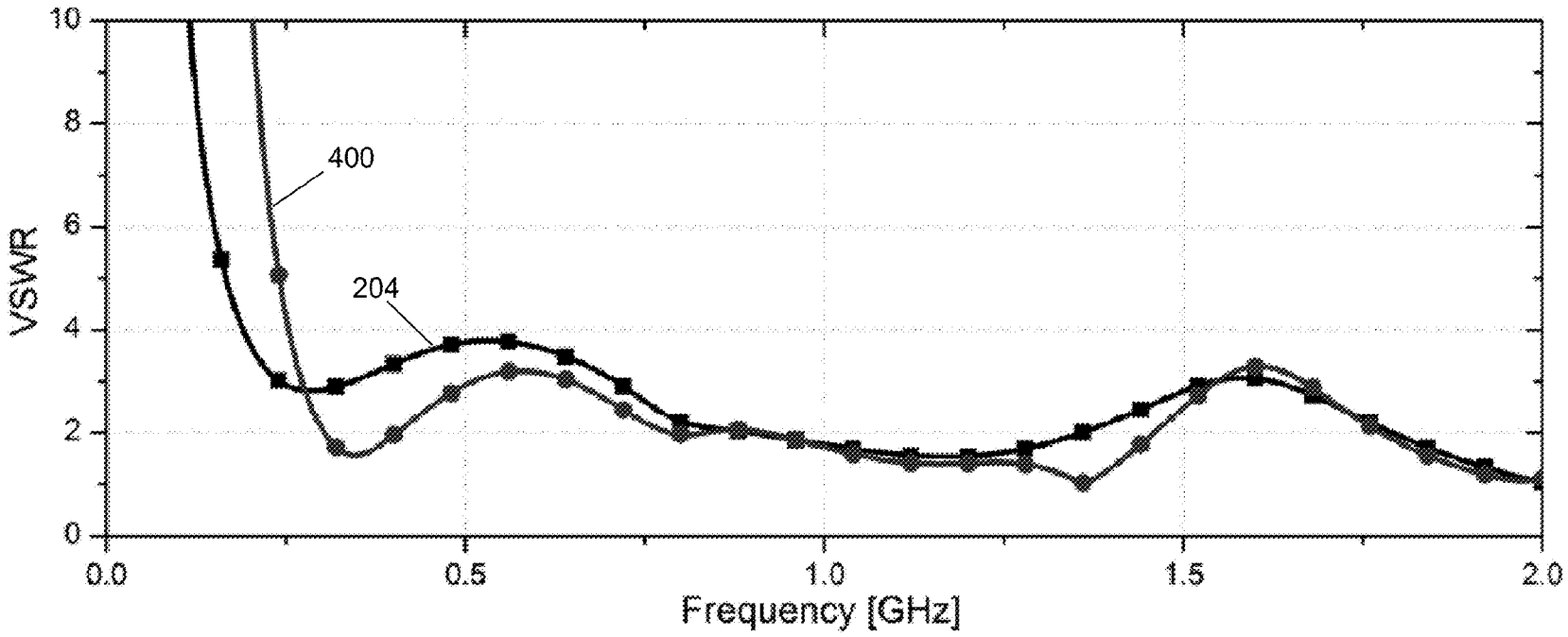
FIG. 4*a* is a graph showing a VSWR determined by simulating the performance of the antenna of FIGS. 1*a* and 3*a*.

With reference to FIG. 4*a*, a graph is provided that shows a VSWR at feed element 108 determined by simulating the performance of the antenna of FIG. 3*a*. A fourth VSWR curve 400 shows a VSWR as a function of transmit frequency that results by including first shorting arm 302 and second shorting arm 304 with the illustrative dimensions and with top edge 120 having a value equal to 255 mm. Third VSWR curve 204 is included in the graph for comparison.

Figure 4B:
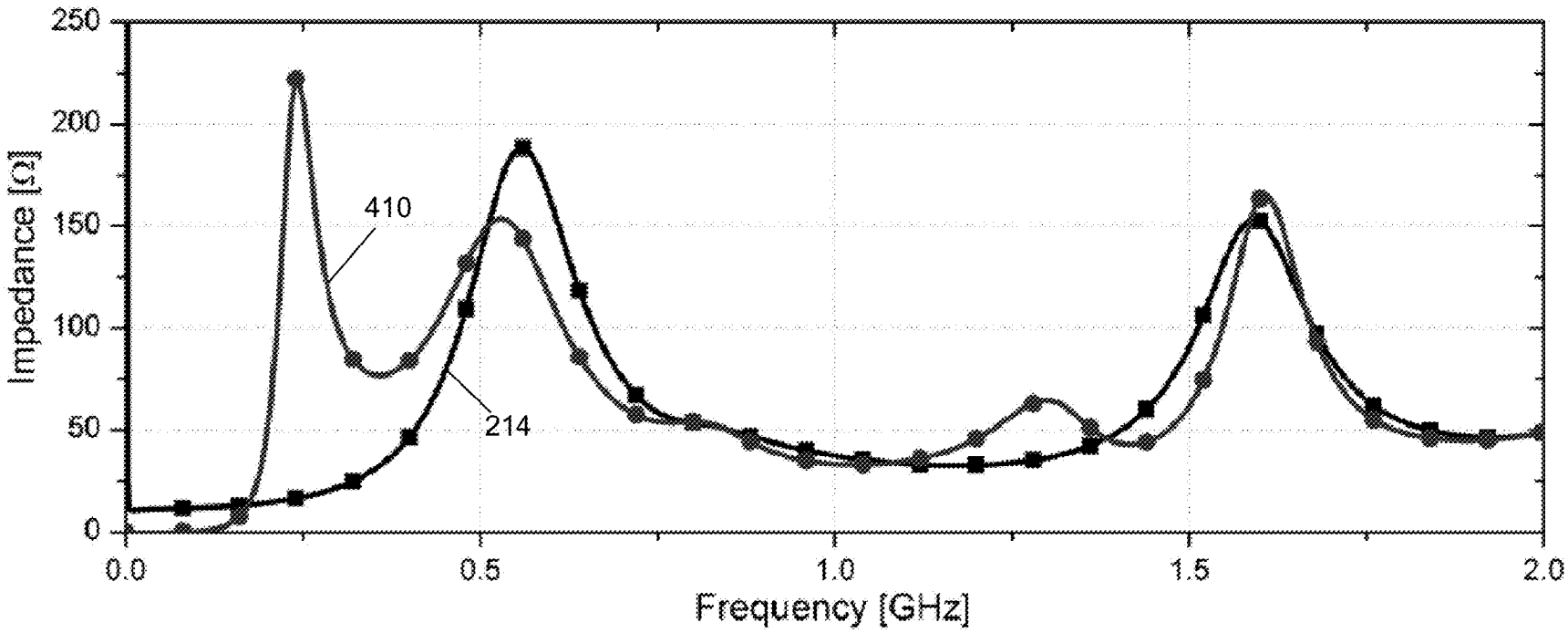
FIG. 4*b* is a graph showing an input resistance determined by simulating the performance of the antenna of FIGS. 1*a* and 3*a*.

With reference to FIG. 4*b*, a graph is provided that shows an input resistance determined by simulating the performance of the antenna of FIG. 3*a*. A fourth resistance curve 410 shows a resistance as a function of transmit frequency that results by including first shorting arm 302 and second shorting arm 304 with the illustrative dimensions and with top edge 120 having a value equal to 255 mm. Third resistance curve 214 is included in the graph for comparison.

Figure 4C:
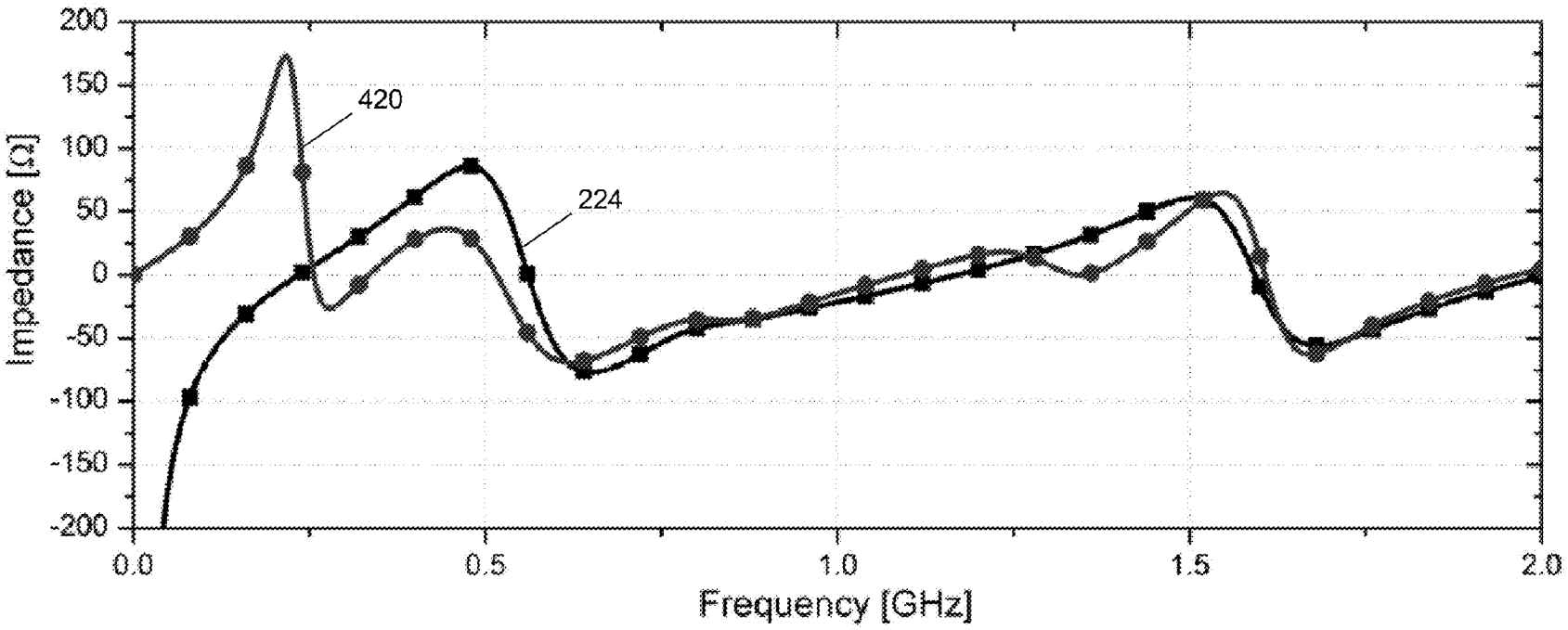
FIG. 4*c* is a graph showing an input reactance determined by simulating the performance of the antenna of FIGS. 1*a* and 3*a*.

With reference to FIG. 4*c*, a graph is provided that shows an input reactance determined by simulating the performance of the antenna of FIG. 3*a*. A fourth reactance curve 420 shows a reactance as a function of transmit frequency that results by including first shorting arm 302 and second shorting arm 304 with the illustrative dimensions and with top edge 120 having a value equal to 255 mm. Third reactance curve 224 is included in the graph for comparison.

The addition of one or more shorting arms results in addition of a parallel inductance. The value of the parallel inductance increases by increasing length 328 or decreasing width 326 of first shorting arm 302 and second shorting arm 304. The parallel inductance due to first shorting arm 302 and second shorting arm 304 and the parallel capacitance due to top hat conductor 104 and ground plane substrate 102 provide a potential parallel resonance below the minimum frequency of operation of antenna 100. The placement, the size, and the shape of the shorting arms have a significant effect on the antenna impedance (resistance and reactance). The shorting arms are designed and optimized such that the introduced additional resonance is close to the minimum desired operating frequency of antenna 100, so they can merge together to achieve an ultra-wideband (UWB) structure.

Figure 5B:
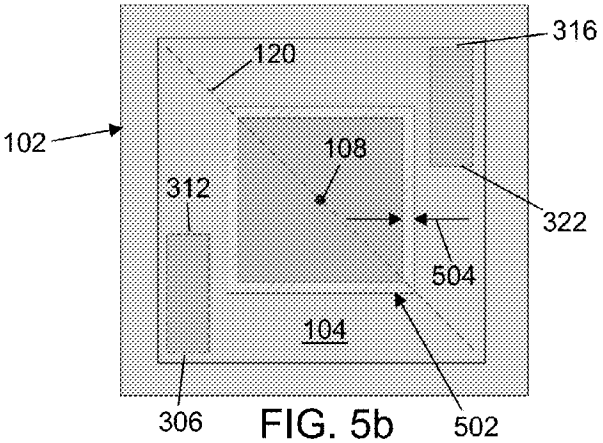
FIG. 5*b* is a top view of the top-loaded conical antenna of FIG. 5*a* in accordance with an illustrative embodiment.
Figure 5A:
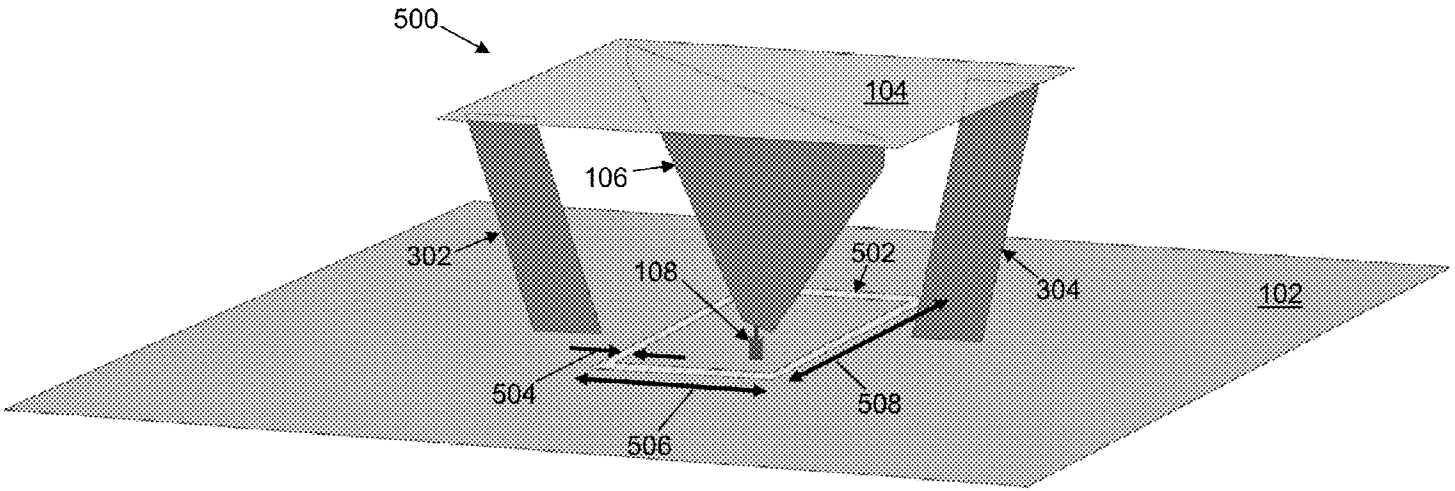
FIG. 5*a* is a perspective view of a top-loaded conical antenna including a plurality of shorting arms and a rectangular ground plane slot in accordance with an illustrative embodiment.

With reference to FIG. 5*a*, a perspective view of a third antenna 500 is shown in accordance with an illustrative embodiment. Third antenna 500 may include ground plane substrate 102, top hat conductor 104, feed conductor 106, feed element 108, first shorting arm 302, second shorting arm 304, and a ring slot 502. In the illustrative embodiment, ring slot 502 is a rectangular slot formed in ground plane substrate 102. For example, ring slot 502 may be etched or milled into ground plane substrate 102. Ring slot 502 is symmetrically positioned to surround feed element 108. In alternative embodiments, ring slot 502 may be positioned asymmetrically relative to feed element 108. Ring slot 502 may form other polygonal, circular, or elliptical shapes in the x-y plane.

For simplicity in fabrication, a dielectric material with a top surface formed of a metal sheet is used as ground plane substrate 102, and ring slot 502 is formed by etching of ground plane substrate 102. The dielectric constant of ground plane substrate 102 can change the value of capacitance formed by ring slot 502. To minimize the effect of the material, a low dielectric material can be used as ground plane substrate 102.

In an illustrative embodiment, ring slot 502 has a slot width 504, a width 506 in the x-direction, and a length 508 in the y-direction. In an illustrative embodiment, slot width 504 is approximately 7 mm, width 506 is approximately 203 mm, and length 508 is approximately 203 mm though other dimensions may be used depending on the application of antenna 100, and of course, the other dimensions of the components of third antenna 500. Ring slot 502 does not radiate in the band of interest; instead, ring slot 502 acts as a series capacitance. The value of the series capacitance increases by decreasing width 506 of ring slot 502 or by decreasing slot width 504 of ring slot 502. The values for slot width 504 and width 506 may be chosen by examining the effect of these two parameters on VSWR, input impedance, and input reactance of antenna 100 to reduce the quality factor of the additional resonance and achieve an impedance match across the entire band.

Figure 6:
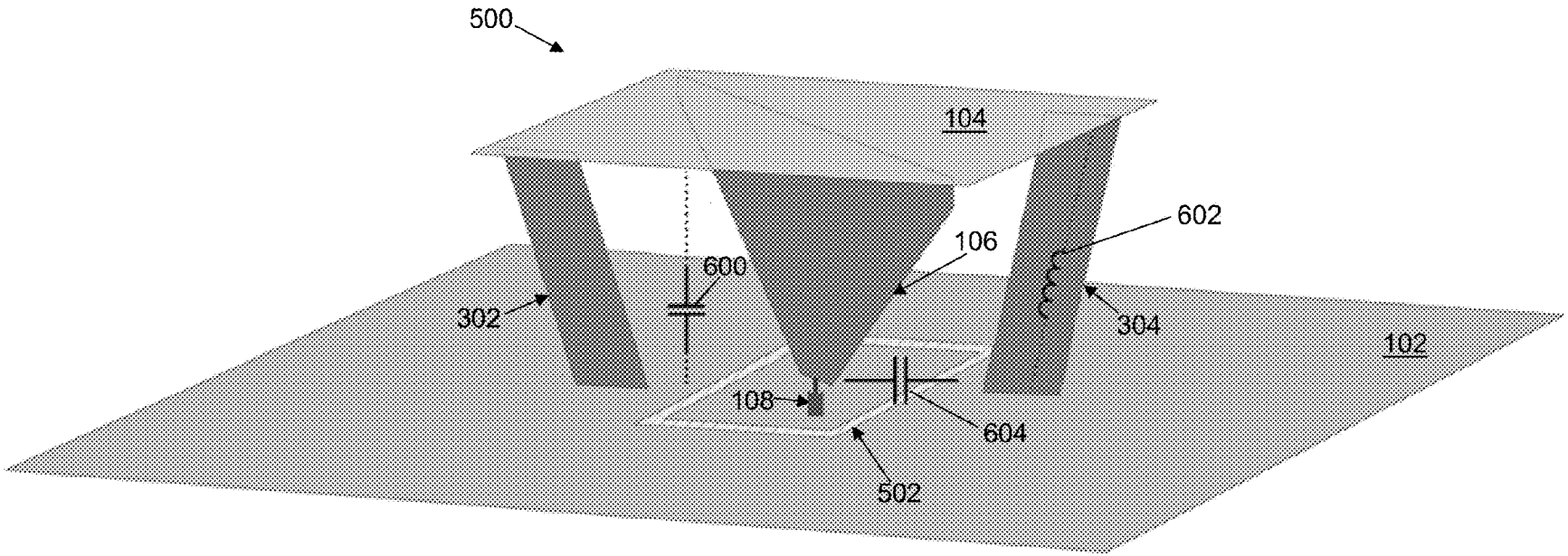
FIG. 6 is a perspective view of the top-loaded conical antenna of FIG. 5*a* showing equivalent circuit elements for each part in accordance with an illustrative embodiment.

With reference to FIG. 6, the effect of top hat conductor 104 is modeled as a parallel capacitance 600, the effect of first shorting arm 302 and second shorting arm 304 is modeled as a parallel inductance 602, and the effect of ring slot 502 is modeled as a series capacitance 604. Third antenna 500 can be designed using the equivalent circuit model illustrated in FIG. 6 and full wave EM simulation. The placement, mounting angle, and shape of first shorting arm 302 and second shorting arm 304 and the placement and shape of ring slot 502 have a significant effect on the impedance of third antenna 500. These characteristics are designed and optimized using full wave EM simulation such that the impedance is well-matched and centered on the Smith chart used for analysis of impedance matching.

Figure 7A:
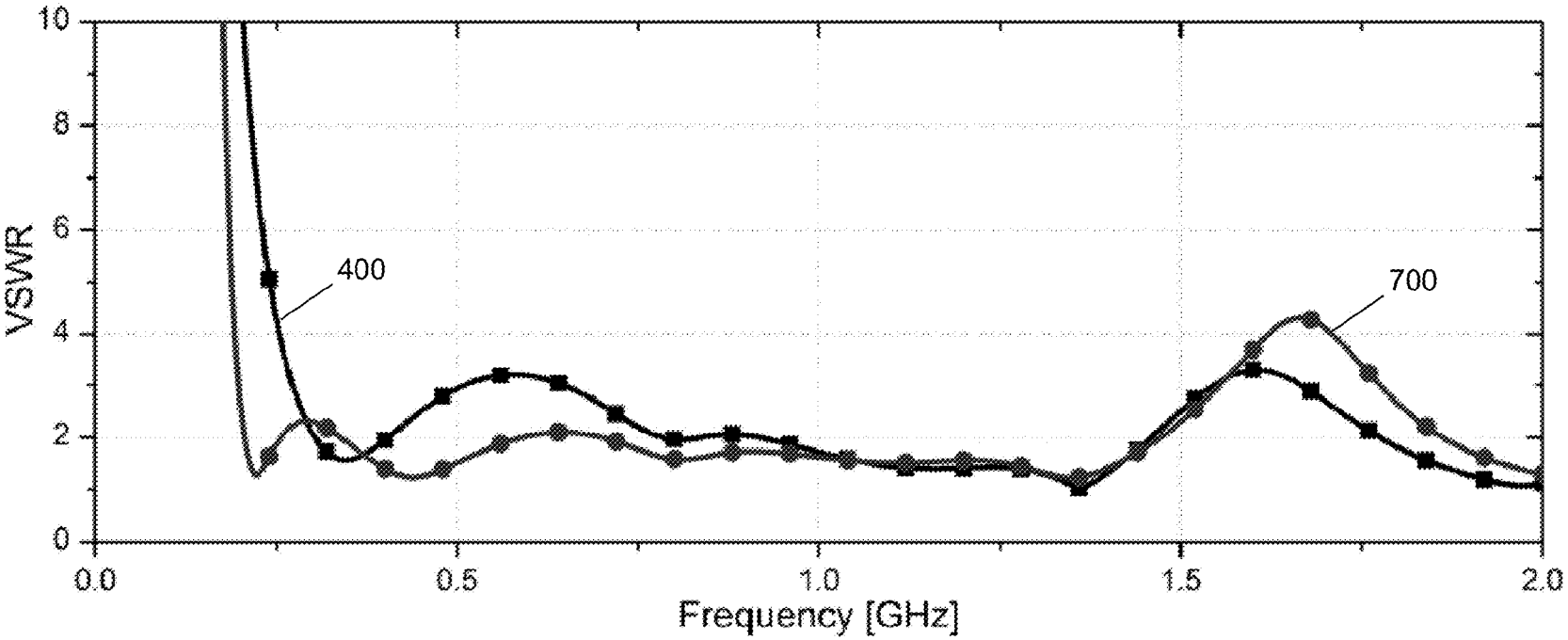
FIG. 7*a* is a graph showing a VSWR determined by simulating the performance of the antenna of FIGS. 3*a* and 5*a*.

With reference to FIG. 7*a*, a graph is provided that shows a VSWR at feed element 108 determined by simulating the performance of the antenna of FIG. 5*a*. A fifth VSWR curve 700 shows a VSWR as a function of transmit frequency that results by including ring slot 502 with the illustrative dimensions and with top edge 120 having a value equal to 255 mm. Fourth VSWR curve 400 is included in the graph for comparison.

Figure 7B:
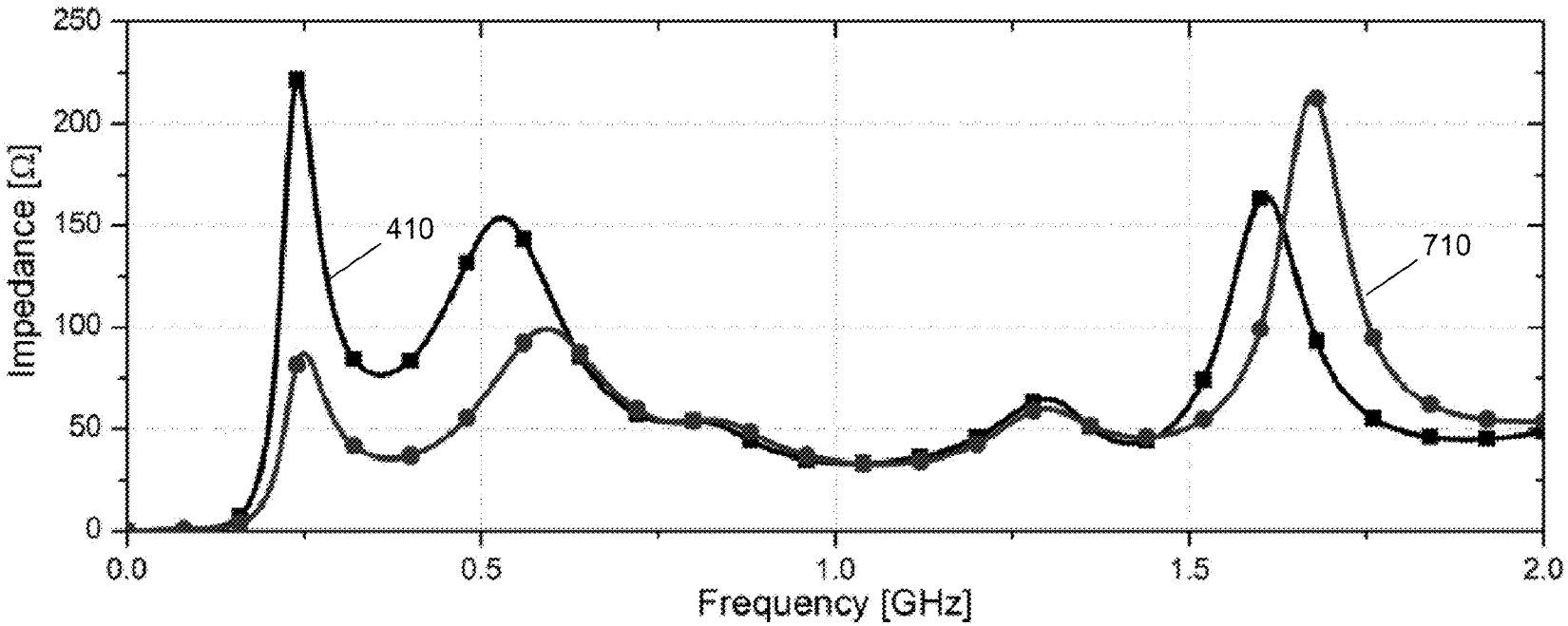
FIG. 7*b* is a graph showing an input resistance determined by simulating the performance of the antenna of FIGS. 3*a* and 5*a*.

With reference to FIG. 7*b*, a graph is provided that shows an input resistance determined by simulating the performance of the antenna of FIG. 5*a*. A fifth resistance curve 710 shows a resistance as a function of transmit frequency that results by including ring slot 502 with the illustrative dimensions and with top edge 120 having a value equal to 255 mm. Fourth resistance curve 410 is included in the graph for comparison.

Figure 7C:
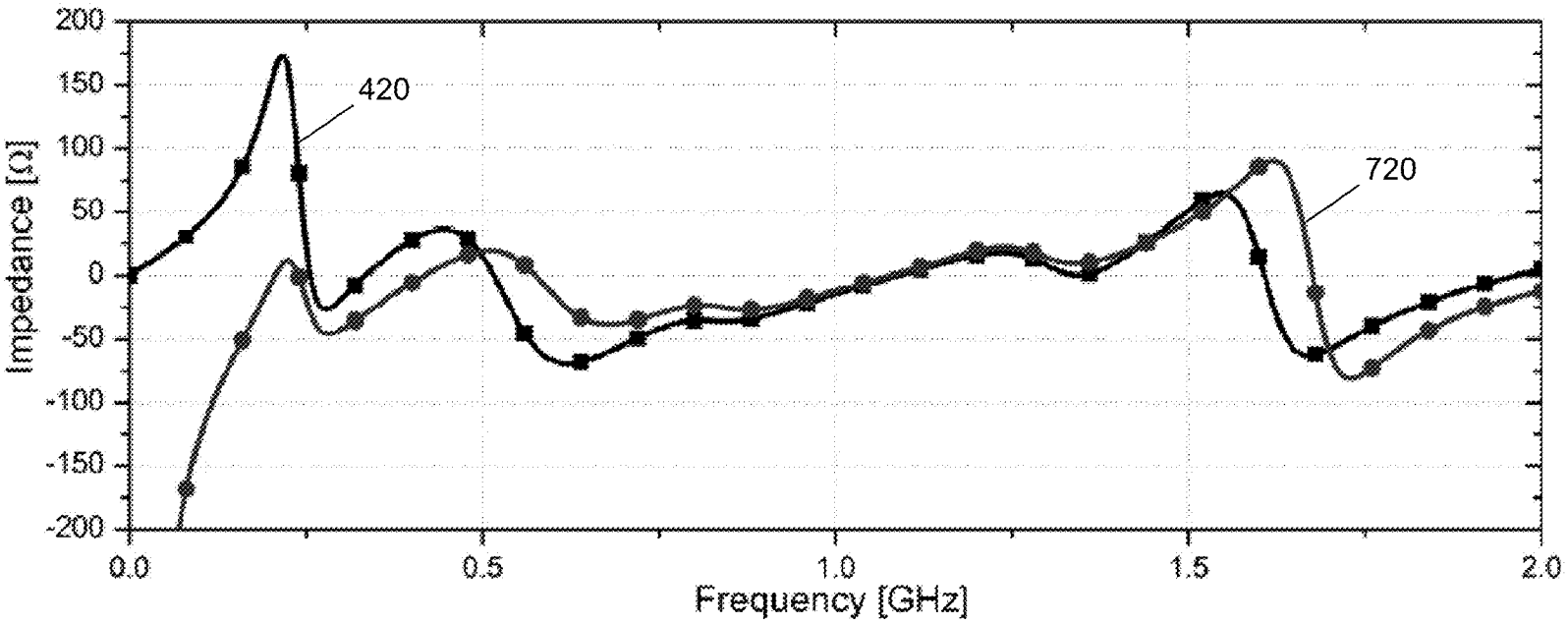
FIG. 7*c* is a graph showing an input reactance determined by simulating the performance of the antenna of FIGS. 3*a* and 5*a*.

With reference to FIG. 7*c*, a graph is provided that shows an input reactance determined by simulating the performance of the antenna of FIG. 5*a*. A fifth reactance curve 720 shows a reactance as a function of transmit frequency that results by including ring slot 502 with the illustrative dimensions and with top edge 120 having a value equal to 255 mm. Fourth reactance curve 420 is included in the graph for comparison.

As shown in FIGS. 7*a*-7*c*, series capacitance 604 helps to decrease the quality factor of the additional resonance, which results in achieving an impedance match across the entire band. The placement and the width of the slot have a significant effect on the capacitance value. The value of the series capacitance increases by decreasing the radius or width 506 of ring slot 502 or by decreasing the radius or slot width 504 of ring slot 502.

Figure 8:
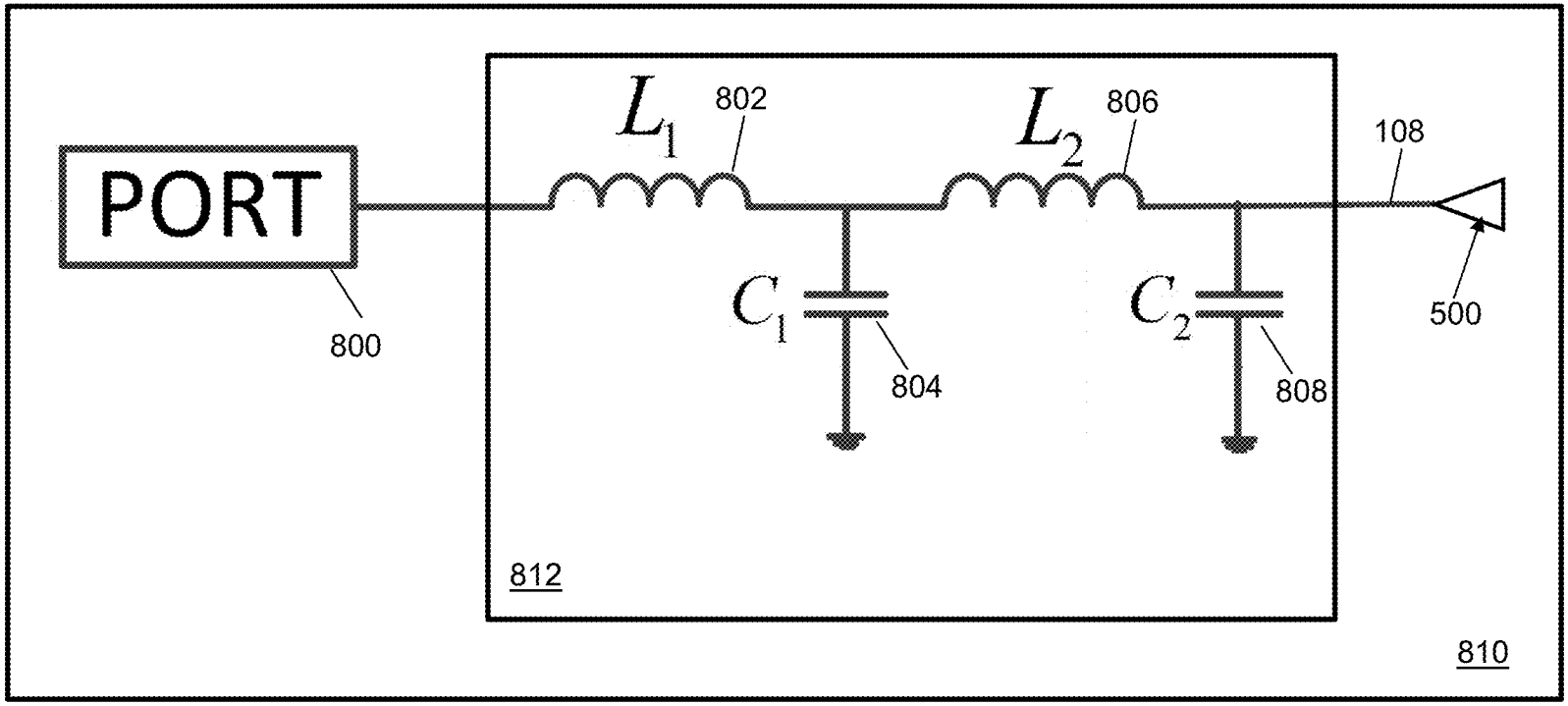
FIG. 8 depicts a lumped matching network of a feed network of an antenna in accordance with an illustrative embodiment.

To obtain the maximum bandwidth available, the transmission and reflection coefficients of third antenna 500 should be unity inside and outside of the band of interest, respectively. With reference to FIG. 8, a feed network 812 is shown in accordance with an illustrative embodiment. Feed network 812 may include a first inductor 802, a first capacitor 804, a second inductor 806, and a second capacitor 808. First inductor 802 and first capacitor 804 are mounted in series between a port 800 and ground plane substrate 102. Second inductor 806 and second capacitor 808 are mounted in series between first inductor 802 and ground plane substrate 102. Feed element 108 is electrically coupled between second inductor 806 and second capacitor 808.

Feed network 812 forms a lumped matching network circuit designed to match the transmission and reflection coefficients of third antenna 500. The values of first inductor 802, first capacitor 804, second inductor 806, and second capacitor 808 are designed and optimized to achieve an impedance match to third antenna 500 across the entire frequency range. Thus, feed network 812 is coupled to receive a radio frequency (RF) alternating current (AC) signal and to form an impedance matched signal output on feed element 108 for radiation from third antenna 500.

With reference to FIG. 8, a transmitter and/or receiver or transceiver 810 includes port 800, feed network 812, and third antenna 500 in accordance with an illustrative embodiment. The RF AC signal is provided to port 800 from a signal processor (not shown). Feed network 812 is coupled to port 800 to receive the RF AC signal and to form a matched signal output through feed element 108 for radiation from third antenna 500. Feed network 812 is coupled to feed element 108 to receive a second RF AC signal received by third antenna 500 and to form a matched signal output through port 800 to the signal processor.

Figure 9A:
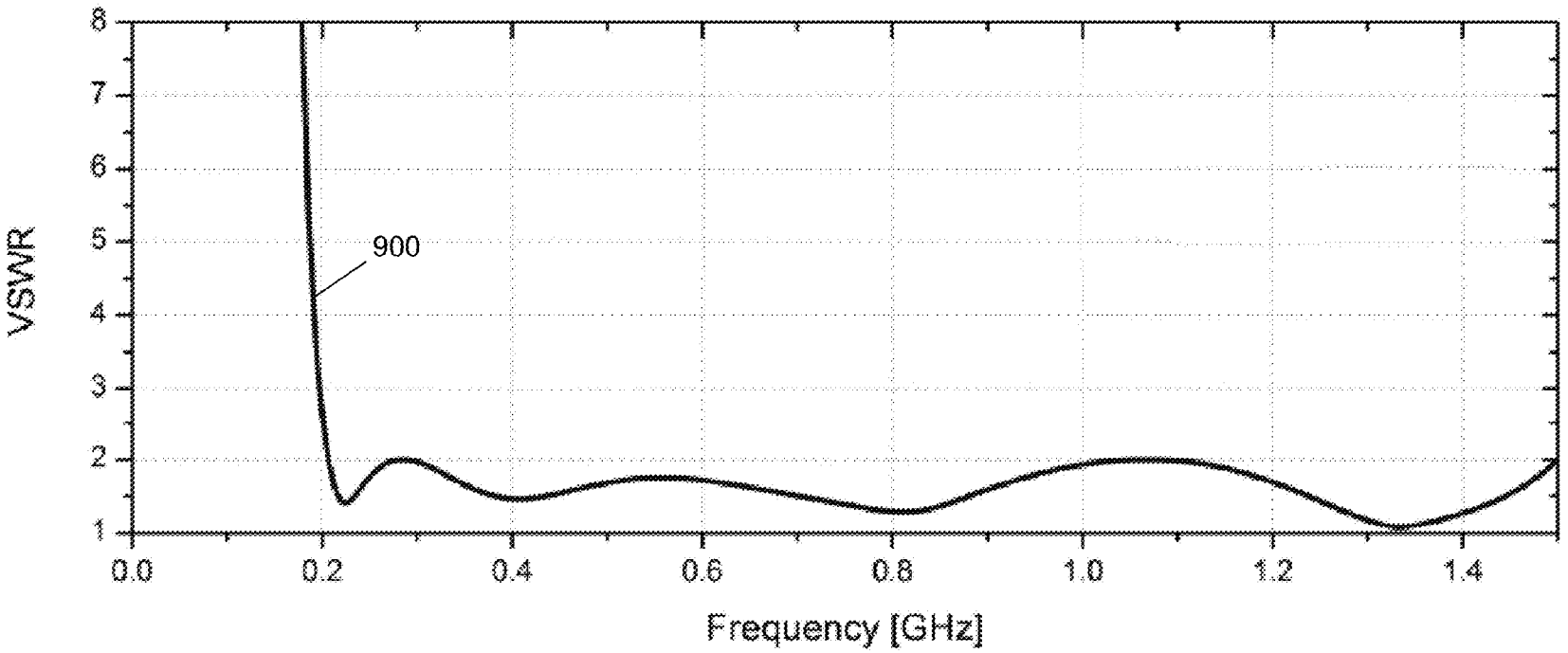
FIG. 9*a* is a graph showing a VSWR determined by simulating the performance of the antenna of FIG. 5*a* using the lumped matching network of FIG. 8.

With reference to FIG. 9*a*, a graph is provided that shows a VSWR at feed element 108 determined by simulating the performance of third antenna 500 with the illustrative dimensions (top edge 120 having a value equal to 255 mm) and using feed network 812. In the illustrative embodiment, an inductance value for first inductor 802 was 5.25 nanoHenry (nH), a capacitance value for first capacitor 804 was 2.2 picoFarads (pF), an inductance value for second inductor 806 was 4.4 nH, and a capacitance value for second capacitor 808 was 1.6 pF. A sixth VSWR curve 900 shows a resulting VSWR as a function of transmit frequency.

Figure 9B:
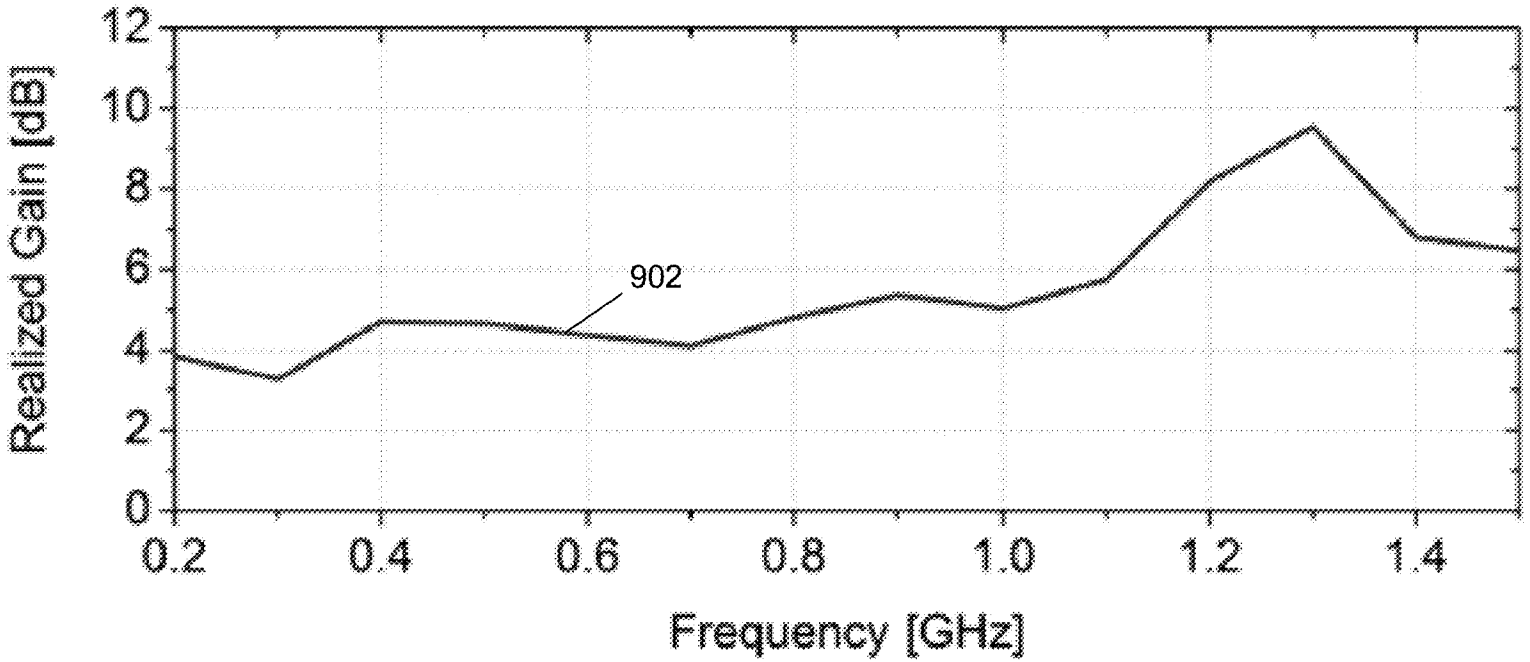
FIG. 9*b* is a graph showing a realized gain determined by simulating the performance of the antenna of FIG. 5*a* using the lumped matching network of FIG. 8.

With reference to FIG. 9*b*, a graph is provided that shows a realized gain of third antenna 500 determined by simulating the performance of third antenna 500 with the illustrative dimensions (top edge 120 having a value equal to 255 mm). A gain curve 902 shows a resulting realized gain as a function of transmit frequency.

Figure 9C:
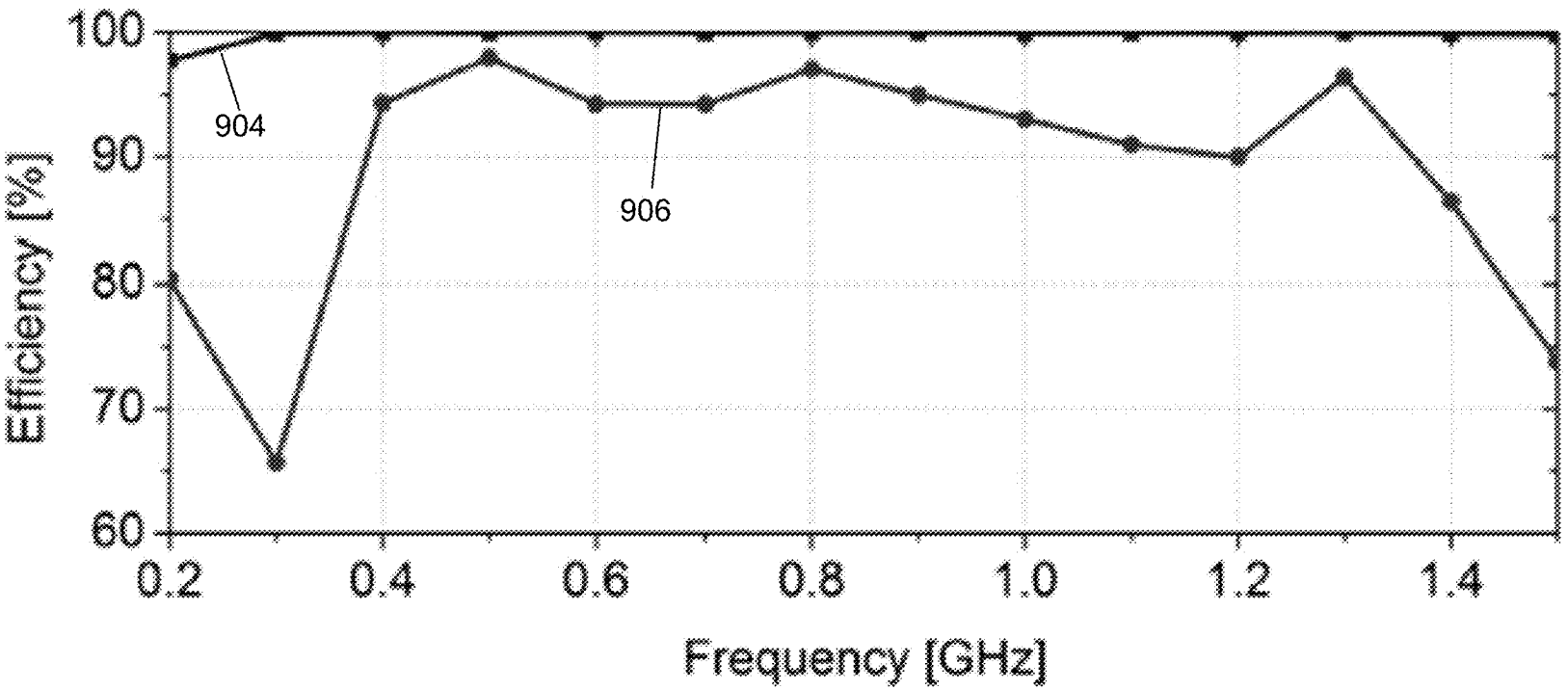
FIG. 9*c* is a graph showing an antenna efficiency determined by simulating the performance of the antenna of FIG. 5*a* using the lumped matching network of FIG. 8.

With reference to FIG. 9*c*, a graph is provided that shows an efficiency of third antenna 500 determined by simulating the performance of third antenna 500 with the illustrative dimensions (top edge 120 having a value equal to 255 mm). A first efficiency curve 904 shows a radiation efficiency as a function of transmit frequency using feed network 812. A second efficiency curve 906 shows a total efficiency as a function of transmit frequency. As shown, third antenna 500 achieves a 3.8 dBi realized gain at the lowest frequency of operation and 5 dBi over most of the operating band. Over most of the operating band, the total efficiency remains above 90% though the total efficiency is approximately 65% at lower frequencies.

Figure 10A:
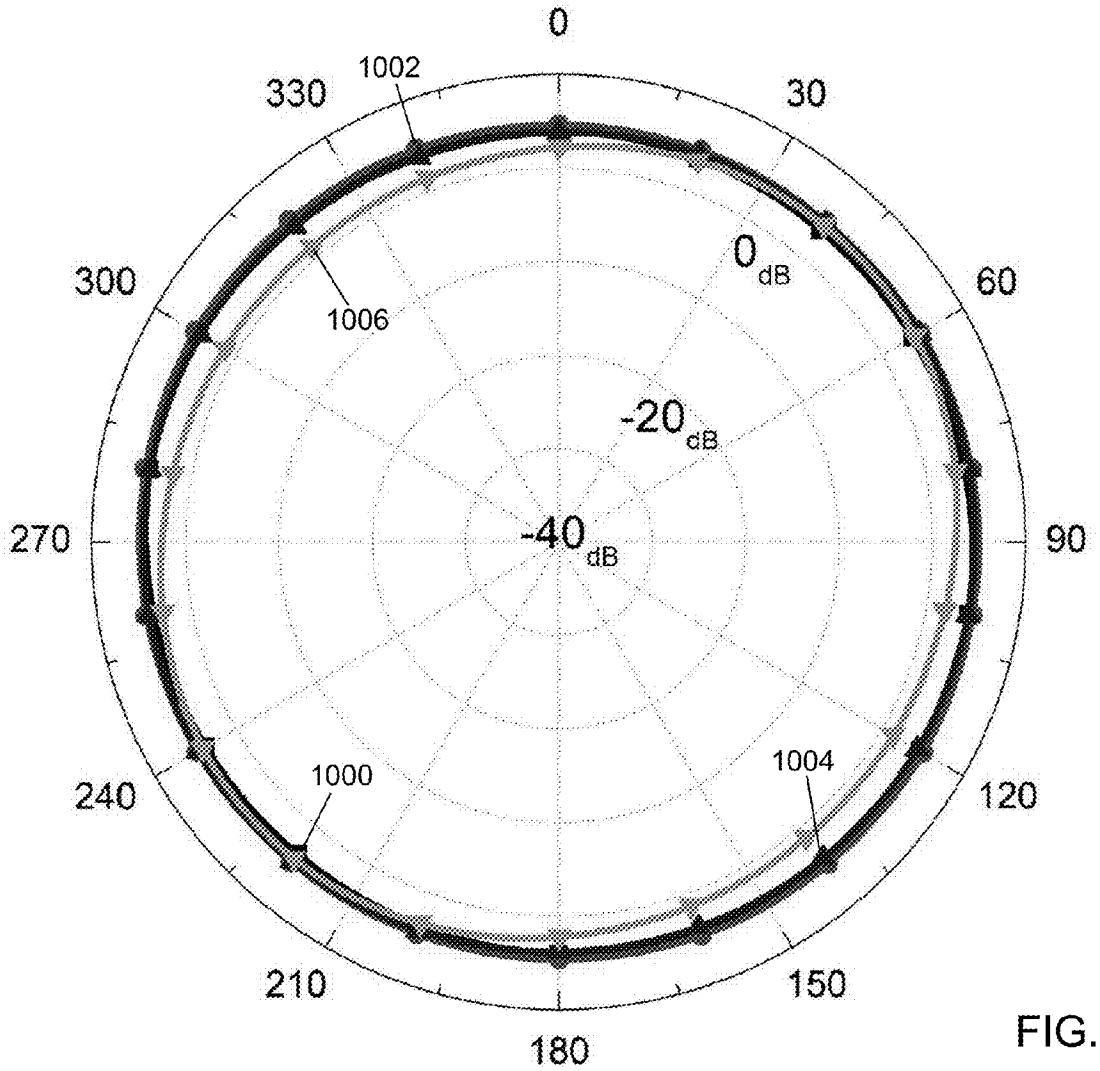
FIGS. 10*a* and 10*b* depict graphs showing directional radiation patterns in the azimuth plane at different frequencies obtained by simulating the performance of the antenna of FIG. 5*a* using the lumped matching network of FIG. 8.
Figure 10B:
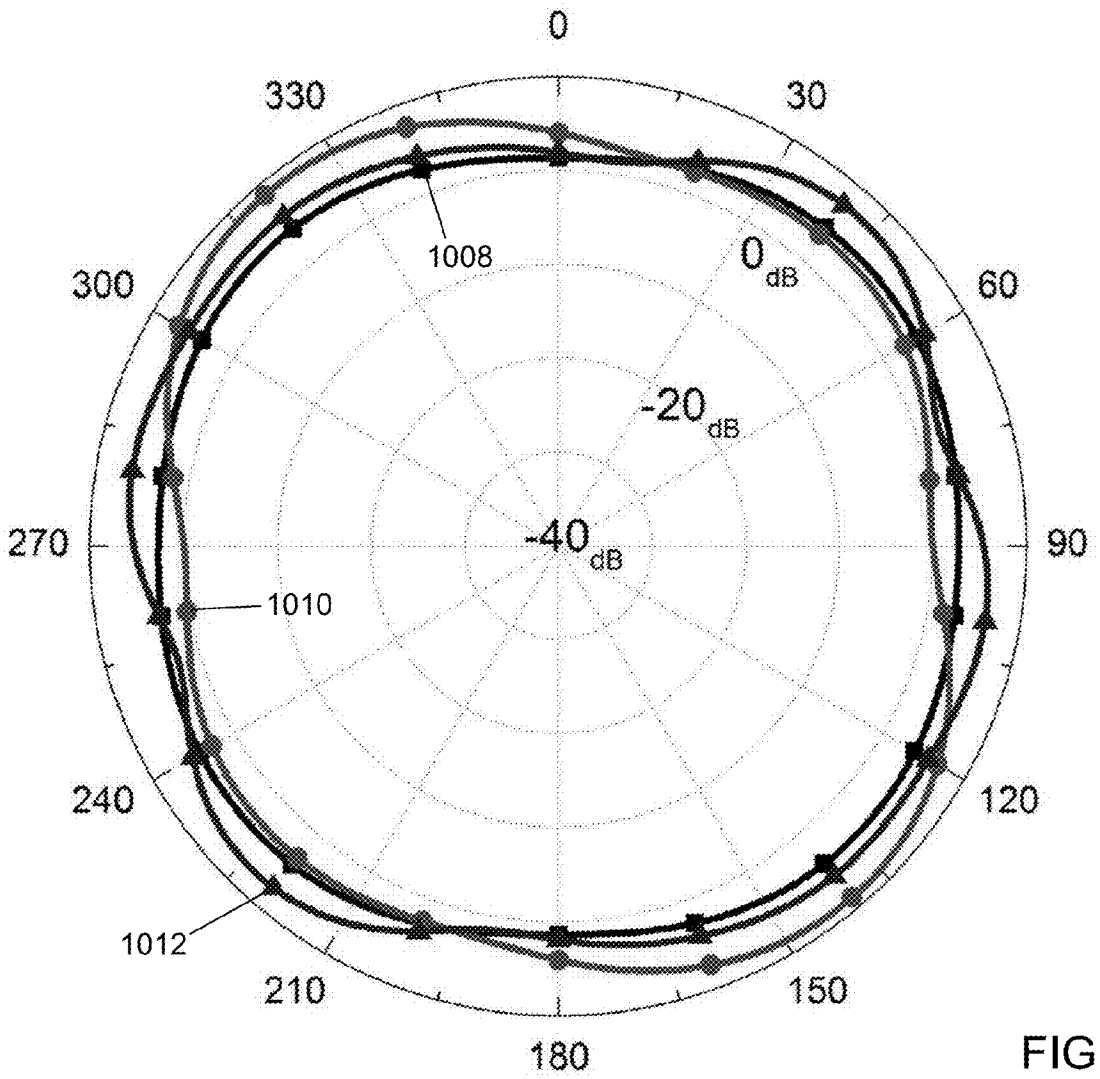

With reference to FIGS. 10*a* and 10*b*, graphs are provided that show directional radiation patterns in the x-y (azimuth) plane in the frequency range of 0.2-1.4 gigahertz (GHz). The results were obtained by simulating the performance of third antenna 500. A first curve 1000 shows the representative response at a frequency of 0.2 GHz; a second curve 1002 shows the representative response at a frequency of 0.4 GHz; a third curve 1004 shows the representative response at a frequency of 0.6 GHz; a fourth curve 1006 shows the representative response at a frequency of 0.8 GHz; a fifth curve 1008 shows the representative response at a frequency of 1.0 GHz; a sixth curve 1010 shows the representative response at a frequency of 1.2 GHz; and a seventh curve 1012 shows the representative response at a frequency of 1.4 GHz.

Figure 11A:
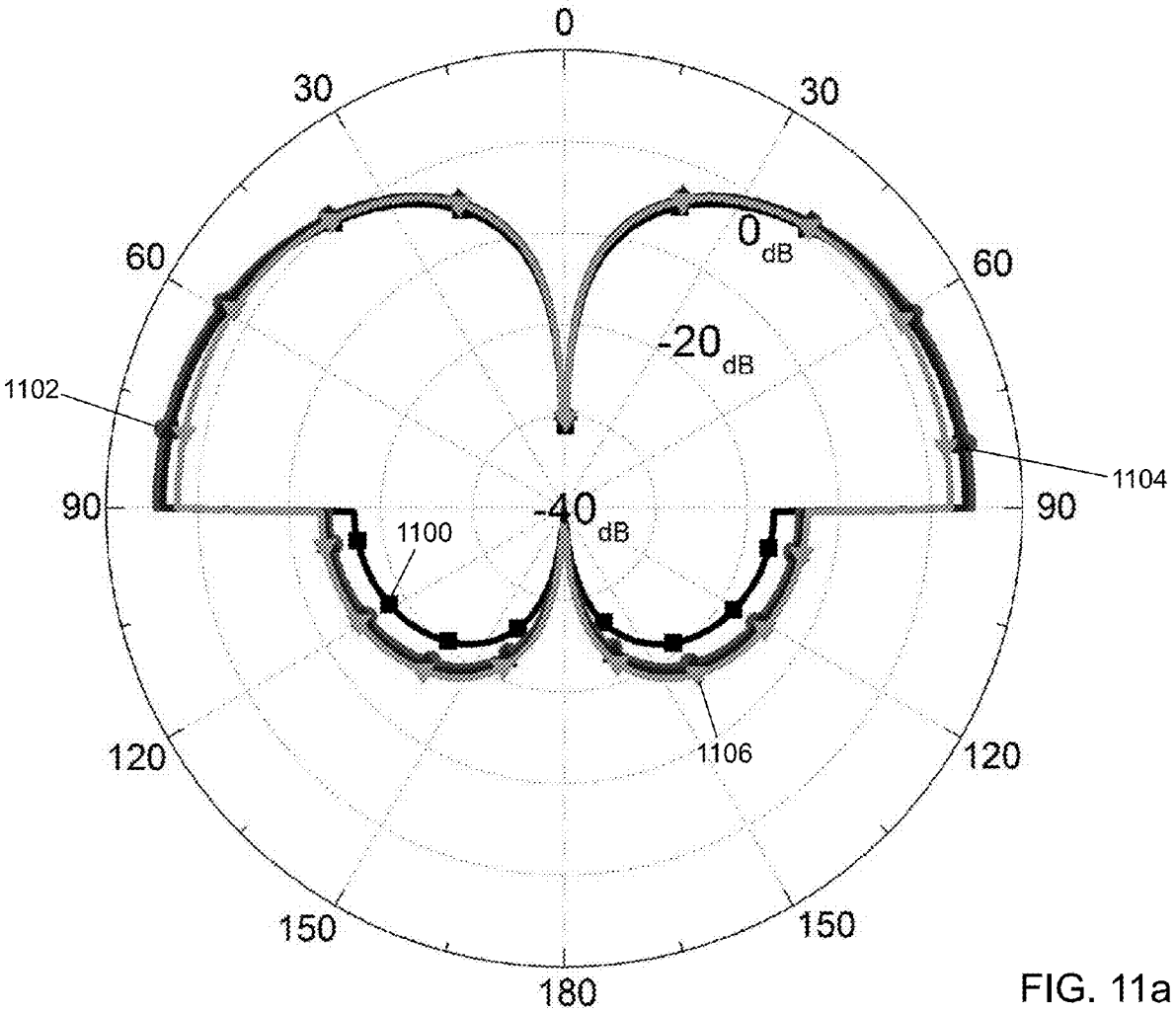
FIGS. 11*a* and 11*b* depict graphs showing directional radiation patterns in the x-z elevation plane at different frequencies obtained by simulating the performance of the antenna of FIG. 5*a* using the lumped matching network of FIG. 8.
Figure 11B:
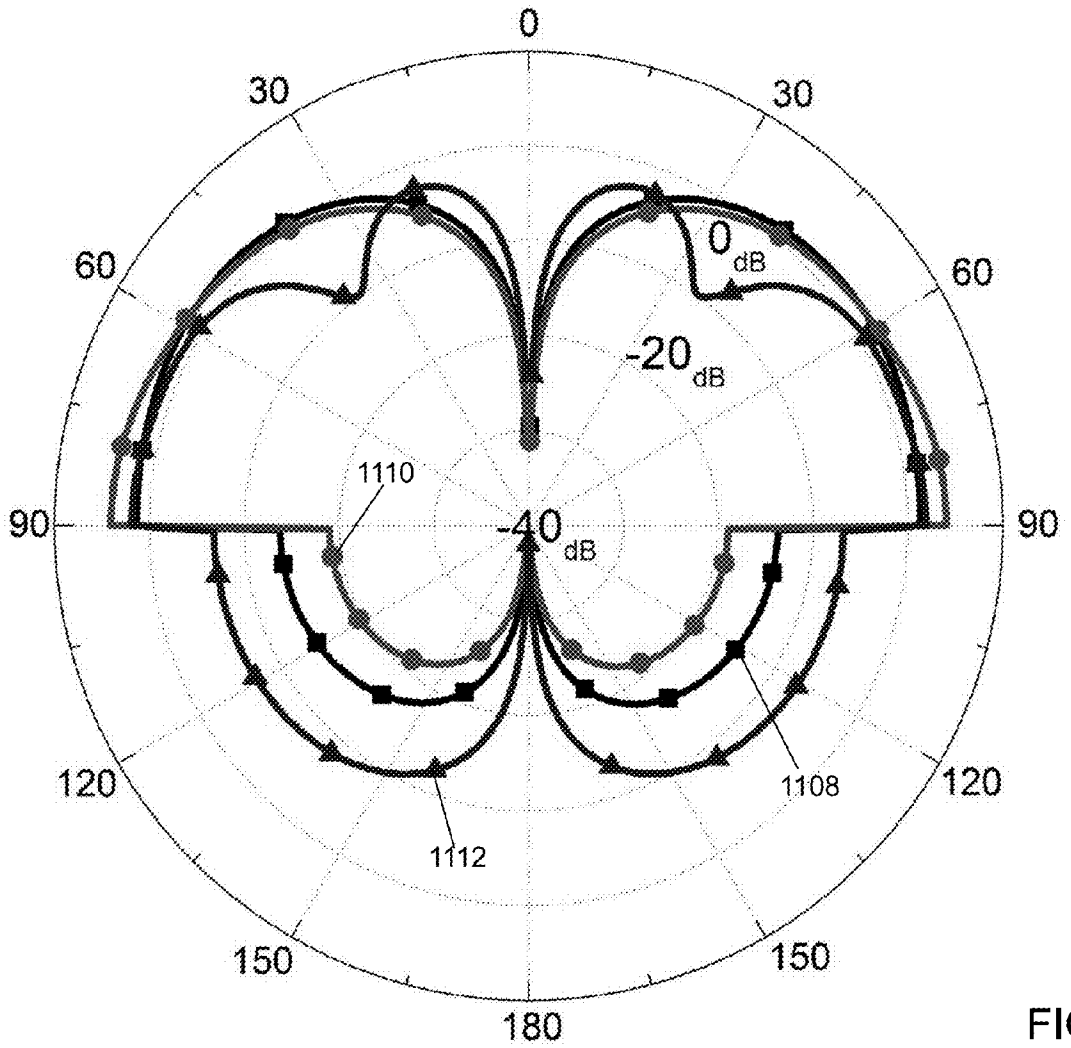

With reference to FIGS. 11*a* and 11*b*, graphs are provided that show directional radiation patterns showing directional radiation patterns in the x-z elevation plane in the frequency range of 0.2-1.4 gigahertz (GHz). A first curve 1100 shows the representative response at a frequency of 0.2 GHz; a second curve 1102 shows the representative response at a frequency of 0.4 GHz; a third curve 1104 shows the representative response at a frequency of 0.6 GHz; a fourth curve 1106 shows the representative response at a frequency of 0.8 GHz; a fifth curve 1108 shows the representative response at a frequency of 1.0 GHz; a sixth curve 1110 shows the representative response at a frequency of 1.2 GHz; and a seventh curve 1112 shows the representative response at a frequency of 1.4 GHz.

Figure 12A:
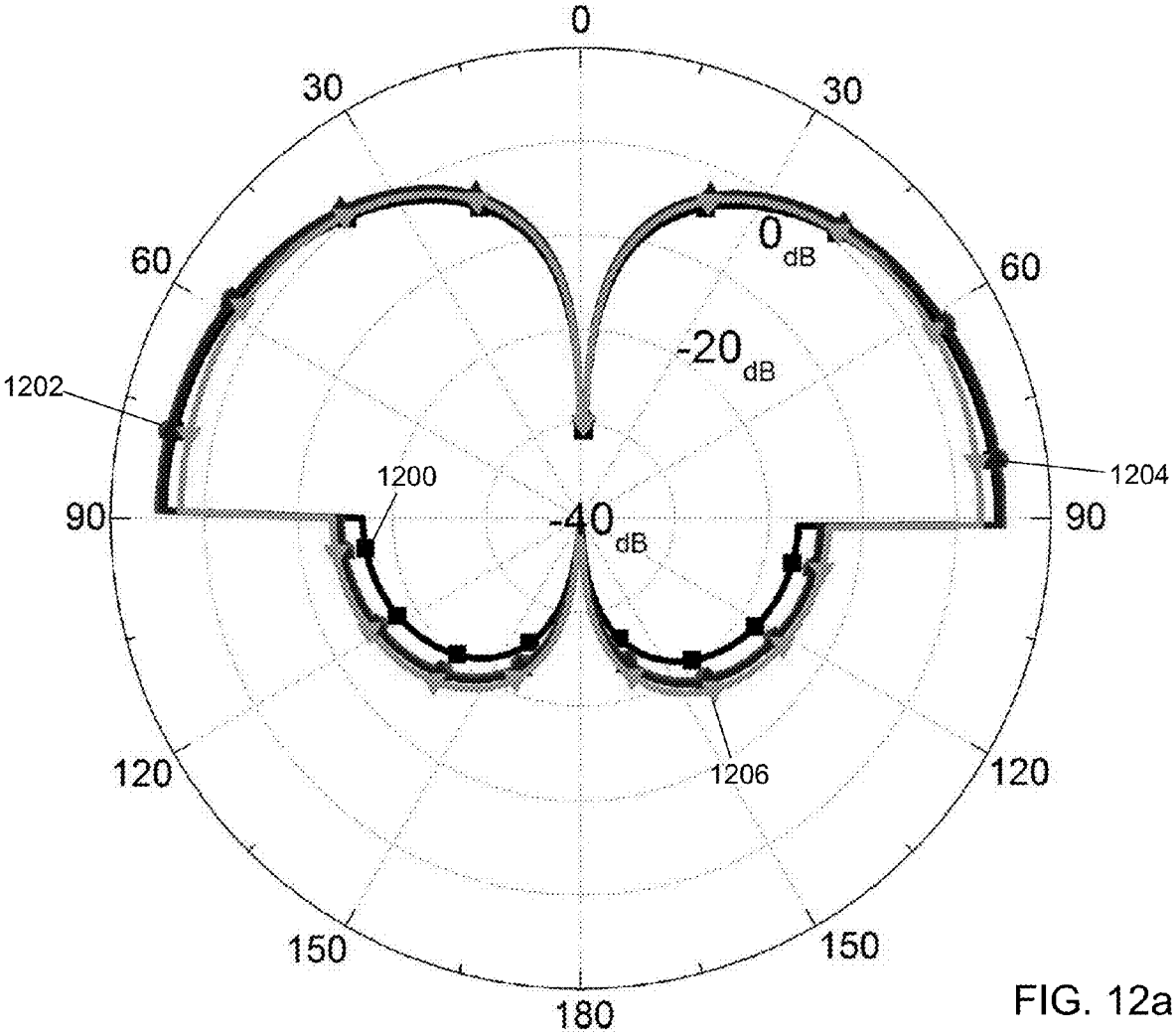
FIGS. 12*a* and 12*b* depict graphs showing directional radiation patterns in the y-z elevation plane at different frequencies obtained by simulating the performance of the antenna of FIG. 5*a*.
Figure 12B:
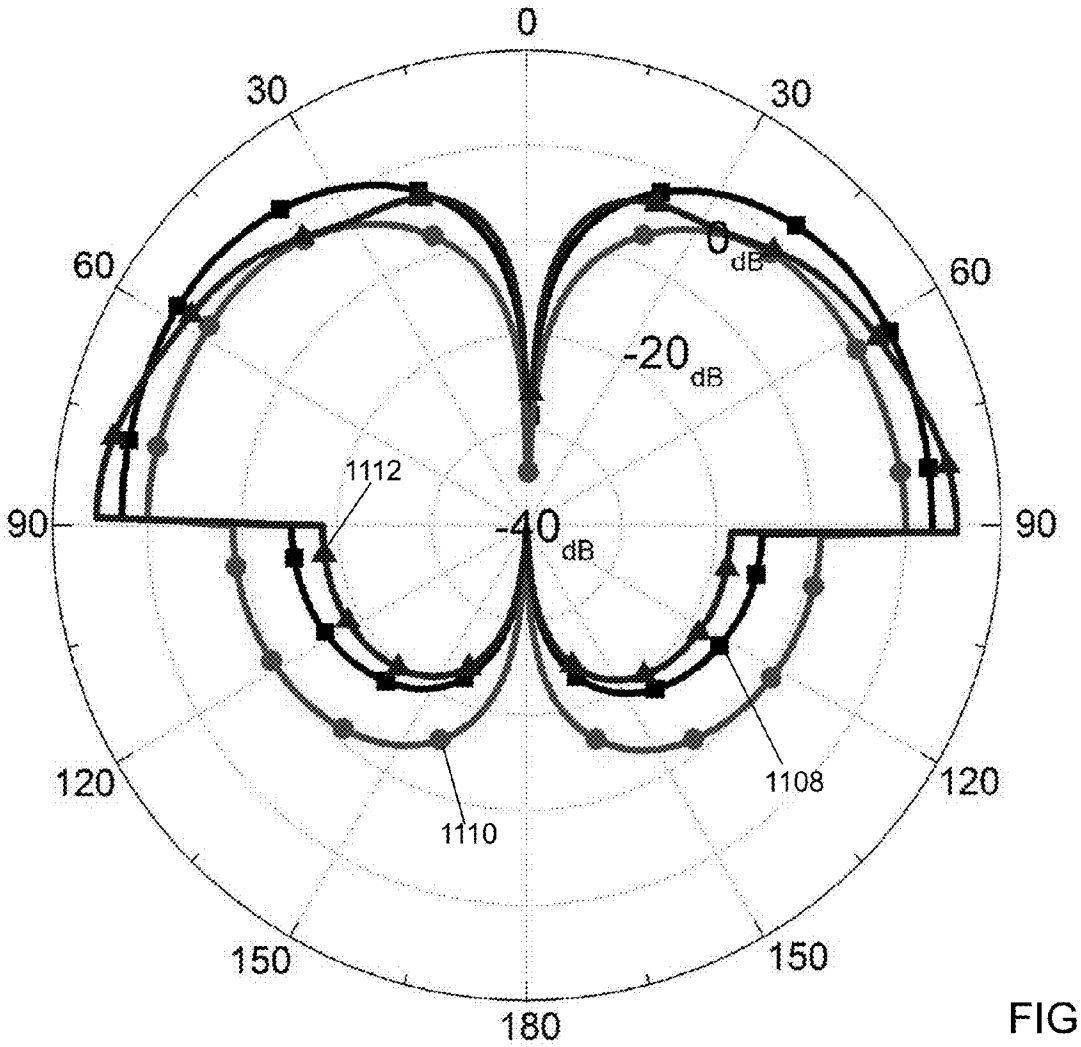

With reference to FIGS. 12*a* and 12*b*, graphs are provided that show directional radiation patterns showing directional radiation patterns in the y-z elevation plane in the frequency range of 0.2-1.4 gigahertz (GHz). A first curve 1200 shows the representative response at a frequency of 0.2 GHz; a second curve 1202 shows the representative response at a frequency of 0.4 GHz; a third curve 1204 shows the representative response at a frequency of 0.6 GHz; a fourth curve 1206 shows the representative response at a frequency of 0.8 GHz; a fifth curve 1208 shows the representative response at a frequency of 1.0 GHz; a sixth curve 1210 shows the representative response at a frequency of 1.2 GHz; and a seventh curve 1212 shows the representative response at a frequency of 1.4 GHz.

The simulated results demonstrate that third antenna 500 provides monopole-like omnidirectional radiation patterns over the entire frequency band of interest. Additionally, third antenna 500 using feed network 812 of FIG. 8 achieves a VSWR lower than 2:1 over a 7.5:1 bandwidth. For third antenna 500, the value of the comparison factor is 27.6, which is more than twice that of the Goubau antenna as a standard small wideband antenna. As a result, third antenna 500 provides a better design in terms of the bandwidth-to-size ratio. At the lowest frequency of operation, third antenna 500 using feed network 812 of FIG. 8 has electrical dimensions of $0.065\lambda_{min}\times0.13\lambda_{min}\times0.13\lambda_{min}$, where $\lambda_{min}$ is the free space wavelength at the lowest frequency of operation ~0.2 GHz.

Figure 13:
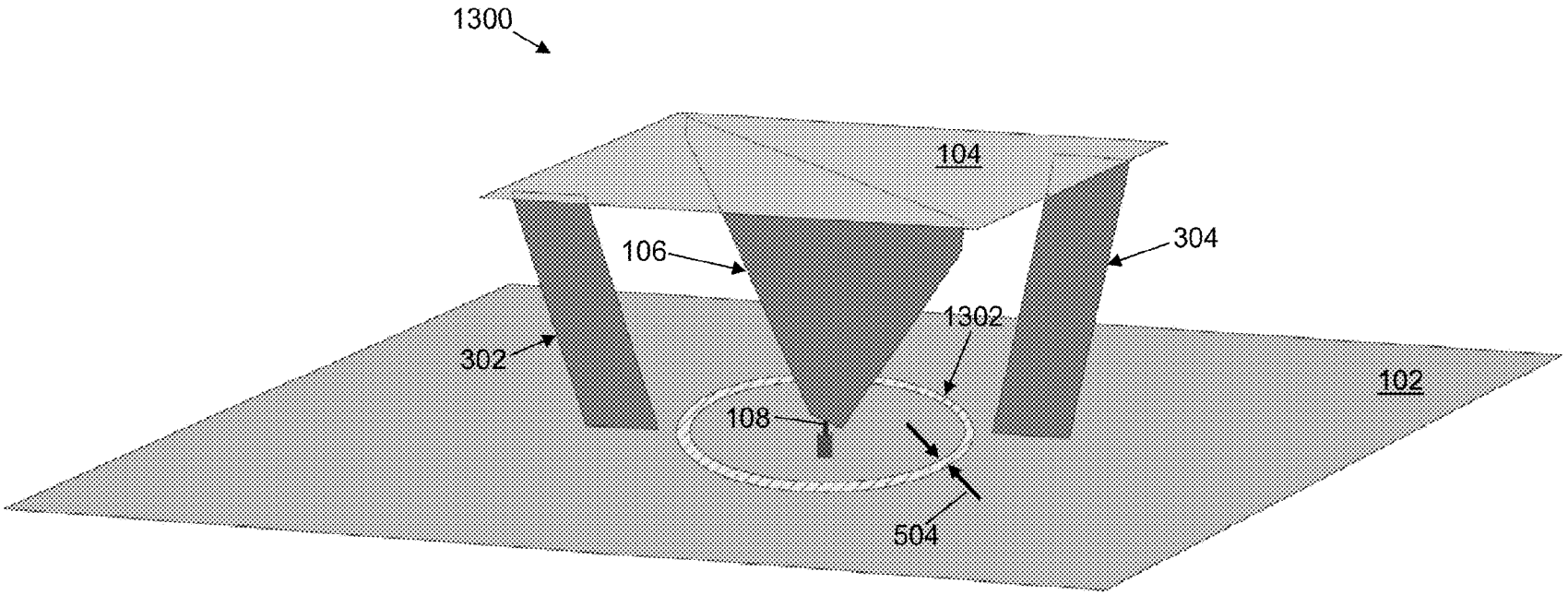
FIG. 13 is a perspective view of a top-loaded conical antenna including a plurality of shorted arms and a circular ground plane slot in accordance with an illustrative embodiment.

With reference to FIG. 13, a perspective view of a fourth antenna 1300 is shown in accordance with an illustrative embodiment. Fourth antenna 1300 may include ground plane substrate 102, top hat conductor 104, feed conductor 106, feed element 108, first shorting arm 302, second shorting arm 304, and a second ring slot 1302. In the illustrative embodiment, second ring slot 1302 is a circular slot formed in ground plane substrate 102. Second ring slot 1302 is symmetrically positioned to surround feed element 108. In an illustrative embodiment, second ring slot 1302 has slot width 504. In an illustrative embodiment, slot width 504 is approximately 7 mm and a diameter of second ring slot 1302 is approximately 203 mm though other dimensions may be used depending on the application of antenna 100, and of course, the other dimensions of the components of third antenna 500.

Figure 14:
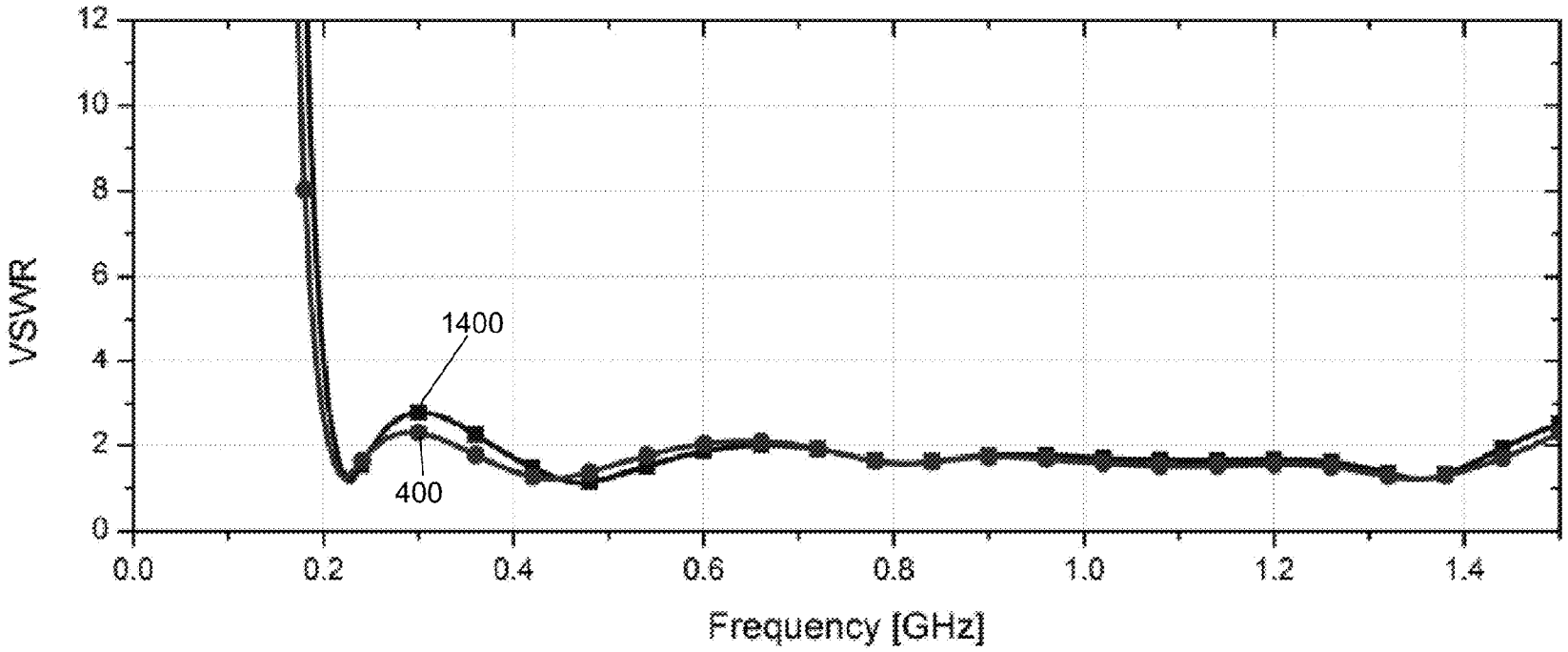
FIG. 14 is a graph showing a VSWR determined by simulating the performance of the antenna of FIGS. 5*a* and 13.

With reference to FIG. 14, a graph is provided that shows a VSWR at feed element 108 determined by simulating the performance of fourth antenna 1300 with the illustrative dimensions. A sixth VSWR curve 1400 shows a VSWR as a function of transmit frequency that results by including ring slot 1302 with top edge 120 having a value equal to 255 mm. Fourth VSWR curve 400 is included in the graph for comparison.

Figure 15:
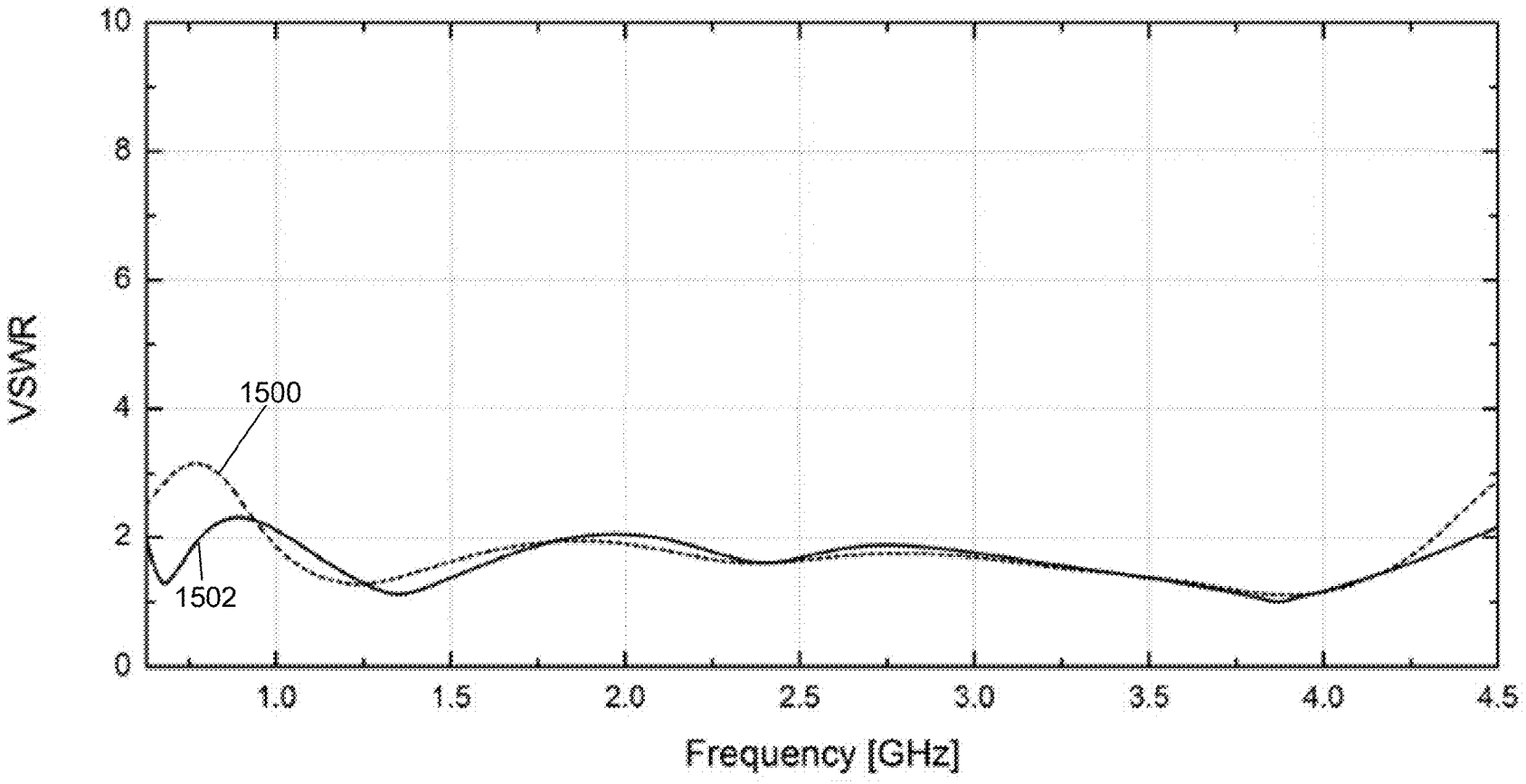
FIG. 15 is a graph showing a comparison between a VSWR determined by simulating the performance of the antenna of FIG. 5*a* and measuring a VSWR using a fabricated prototype of the antenna of FIG. 5*a*.

A prototype of third antenna 500 was fabricated. The prototype was scaled down by a factor of three for simplicity. Thus, the operating frequencies of the antenna scale up by the same factor of three. Feed network 812 was not considered. With reference to FIG. 15, a graph is provided that shows a VSWR at feed element 108 generated by the prototype. A seventh VSWR curve 1500 shows a VSWR as a function of transmit frequency generated by the prototype. An eighth VSWR curve 1502 shows a VSWR as a function of transmit frequency determined by simulating the scaled version of the antenna. Eighth VSWR curve 1502 is included in the graph for comparison. The prototype results compare favorably with the simulated results. In the fabricated prototype, Rogers 5880 material with a dielectric constant of 2.2 was used to form ground plane substrate 102.

Figure 16A:
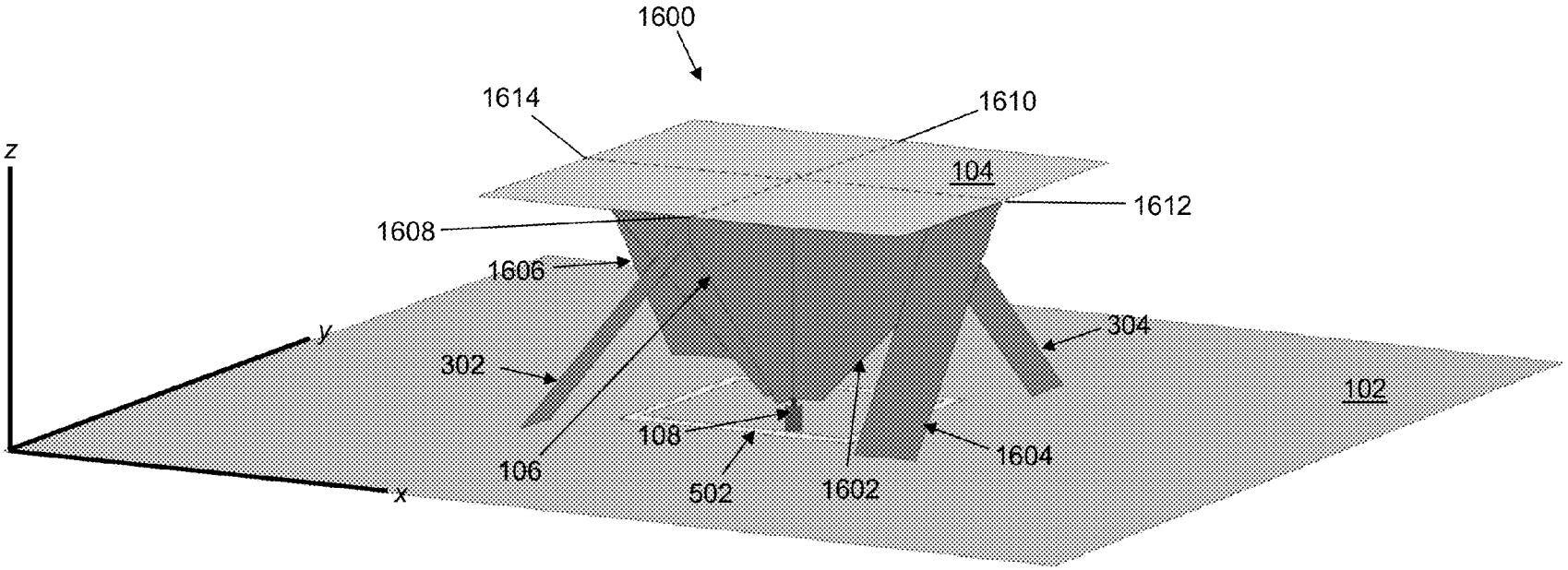
FIG. 16*a* is a perspective view of a top-loaded conical antenna including a plurality of shorting arms and a ground plane slot in accordance with a second illustrative embodiment.

With reference to FIG. 16*a*, a perspective view of a fifth antenna 1600 is shown in accordance with an illustrative embodiment. Fifth antenna 1600 may include ground plane substrate 102, top hat conductor 104, a feed conductor 106, a second feed conductor 1602, feed element 108, first shorting arm 302, second shorting arm 304, a third shorting arm 1604, a fourth shorting arm 1606, and ring slot 502. In the illustrative embodiment, second feed conductor 1604 has the same shape as feed conductor 106. In the illustrative embodiment of FIG. 16*a*, first feed conductor 106 is positioned along a center of top hat conductor 104 parallel to the y-z plane, and second feed conductor 1602 is positioned along a center of top hat conductor 104 parallel to the x-z plane.

Figure 16B:
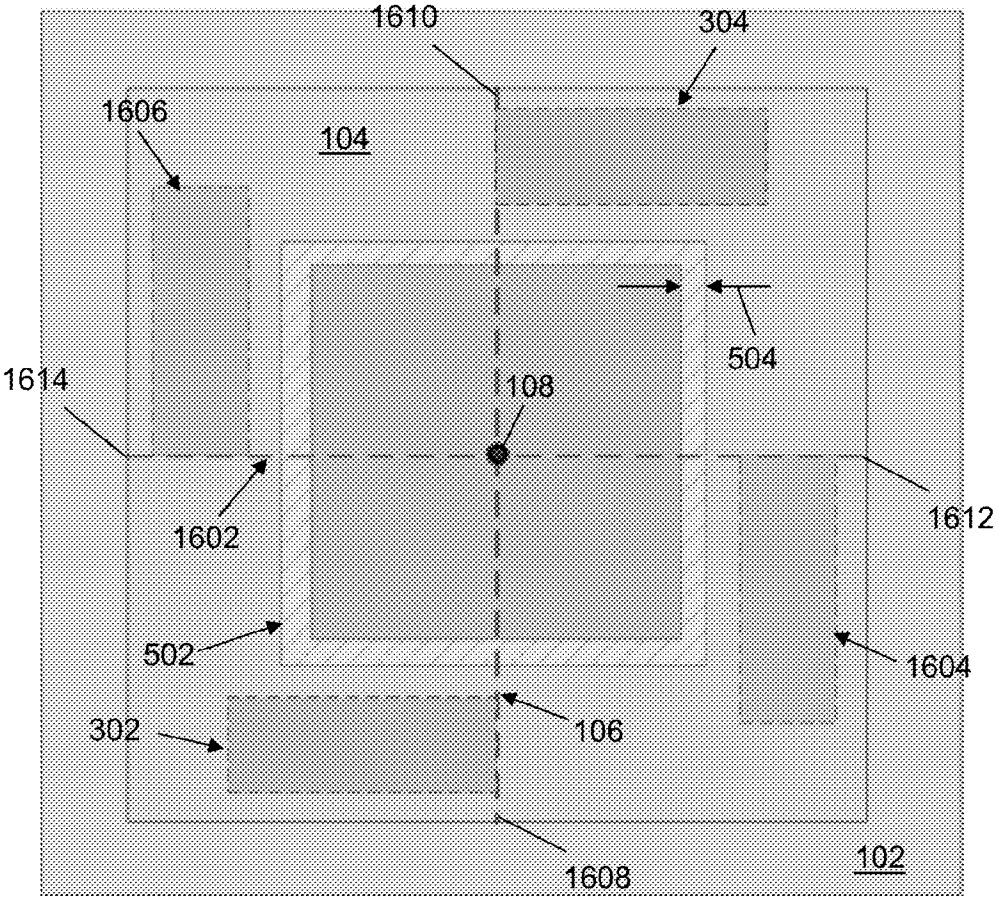
FIG. 16*b* is a top view of the top-loaded conical antenna of FIG. 16*a* in accordance with an illustrative embodiment.

With reference to the illustrative embodiment of FIGS. 16*a* and 16*b*, first shorting arm 302 extends from top hat conductor 104 adjacent a first end 1608 of feed conductor 106, second shorting arm 304 extends from top hat conductor 104 adjacent a second end 1610 of feed conductor 106, third shorting arm 1604 extends from top hat conductor 104 adjacent a first end 1612 of second feed conductor 1602, and fourth shorting arm 1606 extends from top hat conductor 104 adjacent a second end 1614 of second feed conductor 1602.

Using fifth antenna 1600 additional omnidirectionality can be achieved. However, a drawback of adding more feed conductors and shorting arms is an increase in the corresponding parallel inductance and, as a result, an increase in the minimum frequency of operation. Thus, fifth antenna 1600 can be used in applications in which omnidirectionality is a higher priority than lowest frequency of operation.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. An antenna comprising:

a ground plane substrate;

a feed conductor comprising a first end and a second end, wherein the first end is configured for electrical coupling to a feed network through a feed element extending from the ground plane substrate;

a top hat conductor comprising a generally planar sheet mounted to the second end of the feed conductor in a first plane approximately parallel to a second plane defined by the ground plane substrate;

a shorting arm comprising a third end and a fourth end, wherein the third end is mounted to the top hat conductor, and the fourth end is mounted to the ground plane substrate; and a ring slot formed in the ground plane substrate around the feed element and configured to act as a series capacitance.

2. The antenna of claim 1, wherein the top hat conductor forms a polygon when projected into the second plane.

3. The antenna of claim 2, wherein the second end of the feed conductor is mounted along a diagonal of the polygon formed by the top hat conductor.

4. The antenna of claim 1, wherein the top hat conductor forms a circle when projected into the second plane, and the second end of the feed conductor is mounted along a diameter of the circle formed by the top hat conductor.

5. The antenna of claim 1, wherein the top hat conductor forms a rectangle when projected into the second plane.

6. The antenna of claim 5, further comprising a second shorting arm comprising a fifth end and a sixth end, wherein the fifth end is mounted to the top hat conductor, and the sixth end is mounted to the ground plane substrate.

7. The antenna of claim 6, wherein the second end of the feed conductor is mounted along a diagonal of the rectangle formed by the top hat conductor, the shorting arm is mounted to extend from a first corner of the rectangle that does not include the feed conductor, and the second shorting arm is mounted to extend from a second corner of the rectangle that does not include the feed conductor.

8. The antenna of claim 6, wherein the shorting arm and the second shorting arm are generally planar sheets that extend from the top hat conductor and from the ground plane substrate at an angle in the range of 10 to 90 degrees.

9. The antenna of claim 6, further comprising:

a third shorting arm comprising a seventh end and an eighth end, wherein the seventh end is mounted to the top hat conductor, and the eighth end is mounted to the ground plane substrate; and a fourth shorting arm comprising a ninth end and a tenth end, wherein the ninth end is mounted to the top hat conductor, and the tenth end is mounted to the ground plane substrate.

10. The antenna of claim 9, further comprising:

a second feed conductor comprising an eleventh end and a twelfth end, wherein the eleventh end is configured for electrical coupling to the feed network through the feed element;

wherein the top hat conductor is mounted to the twelfth end of the second feed conductor.

11. The antenna of claim 10, wherein the feed conductor is mounted along a first center line between a first pair of opposite sides of the rectangle, the second feed conductor is mounted along a second center line between a second pair of opposite sides of the rectangle, wherein the first pair of opposite sides and the second pair of opposite sides define the rectangle.

12. The antenna of claim 11, wherein the shorting arm is mounted to extend from a first end of the first center line of the top hat conductor, the second shorting arm is mounted to extend from a second end of the first center line of the top hat conductor, the third shorting arm is mounted to extend from a first end of the second center line of the top hat conductor, and the fourth shorting arm is mounted to extend from a second end of the second center line of the top hat conductor.

13. The antenna of claim 1, wherein the feed conductor is a generally planar sheet that extends generally perpendicularly relative to the second plane, further wherein the ring slot acts as the series capacitance between the shorting arm and the feed conductor.

14. The antenna of claim 13, wherein the feed conductor forms a polygon when projected into a plane that is perpendicular to the second plane.

15. The antenna of claim 14, wherein the polygon is primarily cone shaped.

16. The antenna of claim 1, wherein the shorting arm is a generally planar sheet that forms a polygon when projected into the second plane.

17. The antenna of claim 16, wherein the shorting arm forms a rectangle when projected into the second plane.

18. The antenna of claim 1, wherein the ring slot is centered around the feed element and positioned in the ground plane substrate between the feed element and the fourth end of the shorting arm.

19. A transmitter comprising:

a feed network comprising a matching network circuit coupled to receive a signal through a port and to form a matched signal output through a feed element; and an antenna comprising a ground plane substrate;

a feed conductor comprising a first end and a second end, wherein the first end is configured for electrical coupling to the matching network circuit through the feed element to receive the matched signal, wherein the feed element extends from the ground plane substrate;

a top hat conductor comprising a generally planar sheet mounted to the second end of the feed conductor in a first plane approximately parallel to a second plane defined by the ground plane substrate;

a shorting arm comprising a third end and a fourth end, wherein the third end is mounted to the top hat conductor, and the fourth end is mounted to the ground plane substrate; and a ring slot formed in the ground plane substrate around the feed element and configured to act as a series capacitance;

wherein the matching network circuit is configured to impedance match the antenna.

20. The transmitter of claim 19, wherein the matching network circuit comprises a first inductor, a first capacitor, a second inductor, and a second capacitor, wherein the first inductor and the first capacitor are mounted in series between the port and the ground plane substrate, the second inductor and the second capacitor are mounted in series between the first inductor and the ground plane substrate, and the feed element is electrically coupled between the second inductor and the second capacitor.

* * * * *